US010173824B2

(12) United States Patent
Van Den Broek et al.

(10) Patent No.: US 10,173,824 B2
(45) Date of Patent: Jan. 8, 2019

(54) CONTAINER FOR PACKAGING PRODUCTS, IN PARTICULAR FOOD PRODUCTS SUCH AS FRESH MEAT PRODUCTS, AS WELL AS A METHOD FOR PACKAGING SUCH PRODUCTS

(71) Applicants: Lucas Karel Johannes Van Den Broek, Zeewolde (NL); Luc Vandendriessche, Otegem (BE); Louis Rinze Henricus Adrianus Willemsen, Las Pinas (PH)

(72) Inventors: Lucas Karel Johannes Van Den Broek, Zeewolde (NL); Luc Vandendriessche, Otegem (BE); Louis Rinze Henricus Adrianus Willemsen, Las Pinas (PH)

(73) Assignees: Lucas Karel Johannes Van Den Broek, Zeewolde (NL); Louis Rinze Henricus Adrianus Willemsen, Las Pinas (PH)

( * ) Notice: Subject to any disclaimer, the term of this patent is extended or adjusted under 35 U.S.C. 154(b) by 0 days.

(21) Appl. No.: 15/122,873

(22) PCT Filed: Mar. 4, 2015

(86) PCT No.: PCT/NL2015/050134
§ 371 (c)(1),
(2) Date: Aug. 31, 2016

(87) PCT Pub. No.: WO2015/133898
PCT Pub. Date: Sep. 11, 2015

(65) Prior Publication Data

US 2017/0073141 A1 Mar. 16, 2017

(30) Foreign Application Priority Data

Mar. 6, 2014 (NL) ..... 2012377

(51) Int. Cl.
*B65D 25/04* (2006.01)
*B65D 81/26* (2006.01)
(Continued)

(52) U.S. Cl.
CPC ..... *B65D 81/262* (2013.01); *B65B 7/28* (2013.01); *B65B 25/001* (2013.01); *B65D 25/04* (2013.01); *B65D 81/2076* (2013.01)

(58) Field of Classification Search
CPC ... B65D 81/262; B65D 81/2076; B65D 25/04
(Continued)

(56) References Cited

U.S. PATENT DOCUMENTS 2,655,283 A 10/1953 Moldt
2,810,491 A * 10/1957 Goldschmidt ..... B65D 25/02 15/257.074
(Continued)

FOREIGN PATENT DOCUMENTS

BE 885583 A2 4/1891
BE 1008290 A6 3/1996
(Continued)

*Primary Examiner* — King M Chu
(74) *Attorney, Agent, or Firm* — Maginot, Moore & Beck, LLP

(57) ABSTRACT

The invention relates to a container for packaging products, in particular fresh products such as meat products. The container comprises a container body with a product space for accommodating a product and a receiving space at least for receiving liquid, preferably liquid from the product. The container body according to the invention comprises partition means that separate the product space and the receiving space from each other. The partition means comprise at least one outlet opening configured to at least discharge liquid from the product space to the receiving space. The container is further provided with at least one resistance element extending into the receiving space, which resistance element surrounds the outlet opening in such a manner that the
(Continued)

resistance element prevents the transport of liquid from the receiving space to the product space.

23 Claims, 15 Drawing Sheets

(51) Int. Cl.
*B65D 81/20* (2006.01)
*B65B 7/28* (2006.01)
*B65B 25/00* (2006.01)

(58) Field of Classification Search
USPC ..... 206/213.1; 426/129
See application file for complete search history.

(56) References Cited

U.S. PATENT DOCUMENTS

| | | | | |
|---|---|---|---|---|
| 2,875,683 | A | 3/1959 | Burns | |
| 3,067,921 | A | 12/1962 | Reifers | |
| 3,151,799 | A | 10/1964 | Engles, Jr. et al. | |
| 3,155,303 | A * | 11/1964 | Fenkel | B65D 81/265 229/407 |
| 3,718,274 | A | 2/1973 | Reifers et al. | |
| 3,863,833 | A | 2/1975 | Swett et al. | |
| 2004/0142124 | A1 | 7/2004 | Patterson | |

FOREIGN PATENT DOCUMENTS

| | | | |
|---|---|---|---|
| CH | 663943 | A5 | 1/1988 |
| DE | 2500224 | | 7/1975 |
| DE | 202006000102 | U1 | 3/2006 |
| EP | 027530 | | 7/1988 |
| EP | 0517679 | A1 | 12/1992 |
| EP | 2669204 | A1 | 12/2013 |
| FR | 2564807 | A1 | 11/1985 |
| FR | 2577898 | A1 | 8/1986 |
| FR | 2691952 | A1 | 12/1993 |
| FR | 2720054 | A1 | 11/1995 |
| FR | 2740120 | A1 | 4/1997 |
| FR | 2804412 | A1 | 8/2001 |
| GB | 1131848 | | 10/1968 |
| GB | 1527212 | | 10/1978 |
| GB | 2423693 | A | 9/2006 |
| NL | 7512818 | A | 5/1976 |
| NL | 9400005 | A | 8/1995 |
| NL | 9400391 | | 10/1995 |
| NL | 1009555 | C2 | 1/2000 |
| WO | WO198607036 | | 12/1986 |
| WO | WO199306026 | | 4/1993 |
| WO | WO199314995 | | 8/1993 |
| WO | WO199524110 | | 9/1995 |
| WO | WO199936322 | | 7/1999 |
| WO | WO2007133767 | A2 | 11/2007 |

* cited by examiner

CONTAINER FOR PACKAGING PRODUCTS, IN PARTICULAR FOOD PRODUCTS SUCH AS FRESH MEAT PRODUCTS, AS WELL AS A METHOD FOR PACKAGING SUCH PRODUCTS

CROSS REFERENCE TO RELATED APPLICATION

This application claims priority under 35 U.S.C 371 to, and is a U.S. National Stage application of, International Patent Application No. PCT/NL2015/050134, filed Mar. 4, 2015, which claims priority to Dutch Application No. 2012377, filed on Mar. 6, 2014. The entire contents of the above-mentioned patent applications are incorporated herein by reference as part of the disclosure of this application.

The invention relates to a container for packaging products. The invention in particular relates to a container for packaging food products, such as perishable food products, which can exude a liquid. Examples of this include fresh meat products, such as red meat, poultry, but also fish, cheese and the like.

Such a container is generally known in the form of prepackaged portion packages for fresh meat products, in particular raw meat, which packages are generally available in supermarkets and the like. The known container comprises a container body having an internal volume, which forms a product space in which the products, such as the meat products, are contained. In the container, an absorbent material is furthermore provided, which material absorbs liquid exuded from the product, such as meat juices, and retains said juices.

The use of such an absorbent material is undesirable, inter alia for hygienic reasons. Relatively prolonged contact between liquid and food product leads to decay and bacterial growth, so that the standards of hygiene that apply to such containers cannot be complied with.

It is an object of the present invention to provide an improved container in which the liquid from a product is discharged in an effective manner and kept separated from the product and which in addition can be produced in a relatively inexpensive and efficient manner. It is in particular an object of the invention to provide such a container which does not require any adaptation as regards the further packaging process at the meat/fresh fish producer and/or on the part of the consumer in comparison with the packaging process used with known containers.

In order to achieve that object, the container according to the present invention comprises a container body with a product space for accommodating a product therein and a receiving space at least for receiving liquid therein, wherein the container comprises partition means that separate the product space and the receiving space from each other. In a normal position of the container, the product space is at least in part positioned above the receiving space. In a packaged condition, the product is in that case at least partially located above the receiving space. The partition means comprise at least one outlet opening configured to at least discharge liquid from the product space to the receiving space. As a result, liquid can flow from the product space to the receiving space, at least in the normal position of the container. The partition means ensure that the product to be packaged is stored spaced from the liquid contained in the receiving space. As a result there is no longer any contact between the liquid contained in the receiving space and the product to be stored, so that possible decay and bacterial growth are prevented. The container according to the present invention further comprises at least one resistance element. Said resistance element extends into the receiving space, surrounding the outlet opening in such a manner that the resistance element prevents the transport of liquid from the receiving space to the product space. This is in particular the case in a position different from the normal position of the container, for example an inclined position in which the receiving space is positioned beside the product space, in particular an upside-down position of the container, in which, quite the opposite, the receiving space is positioned above the product space. In such a position of the container the resistance element forms a barrier to liquid, so that liquid cannot reach the outlet opening, or at least to a reduced extent. In this way liquid is prevented from flowing back from the receiving space to the product space via the outlet opening. The liquid is thus discharged in a reliable manner and kept separated from the product.

The container according to the present invention can be produced in a relatively inexpensive and simple manner as according to the invention the assembly of container body and the partition means is configured as an integral unit. The partition means in this case form an integral unit with the container body, in particular with a circumferential wall of the container body. This makes it possible to produce the container body in a single step, for example by thermoforming, injection-moulding or another suitable technique.

An advantage of the container according to the present invention is furthermore the fact that it does not require any adaptation as regards the further packaging process at the meat/fresh fish producer. Adaptations as regards consumer behaviour are not required, either.

In one embodiment, the assembly of container body and partition means is at least substantially made of PP (polypropylene). It is also conceivable that the assembly is at least substantially made of a APET (Amorphous Polyethylene Terephthalate/polyester). The above materials are very safe and hygienic materials for food products. The choice of this material (or these materials) provides an adequate protection of the packaged product until the date of expiry thereof. In addition, the materials have excellent transparency properties, which contributes to the sales-stimulating aspect of the package.

The integral assembly can be formed in a simple, efficient and inexpensive manner by means of a thermoforming process.

It is noted in this regard that the partition means according to the invention preferably keep the product space separated from the receiving space in such a manner that a liquid-tight separation between the product space and the receiving space is provided, wherein the transport of liquid is only possible via the outlet opening, or possibly via additional openings, such as further outlet openings. The partition means are in any case configured so that undesirable transport of liquid between the receiving space and the product space is to a large extent prevented.

The skilled person will appreciate that the liquid that is discharged in the present invention is not limited to liquid from the food product, but that said liquid may also comprise other liquids, such as condensation or additives to the food products, for example, such as marinade or preservatives.

In one embodiment, a part of the partition means that faces the receiving space comprises the resistance element. The resistance element forms part of the partition means, which makes the container relatively easy to produce. Because the resistance element forms part of the partition means, the resistance element and the part of the partition means that faces the receiving space form a collecting reservoir for liquid, at least in an inclined position or an upside-down position of the container. Liquid cannot flow over the resistance element in the direction of the outlet opening in that case, so that the transport of liquid from the receiving space to the product space is prevented.

In a simple embodiment, the resistance element comprises a protrusion that extends toward the receiving space. Said protrusion can be formed in the partition means in a relatively simple manner.

In one embodiment, a recess is provided in the part of the partition means that faces the product space so as to obtain a better discharge of liquid from the product. In this way liquid is kept apart from the product.

It is preferable in that regard if the protrusion that extends towards the receiving space corresponds to the recess in the product space. The recess thus at the same time forms the protrusion in the receiving space, as it were. Such an embodiment is compact and easy to produce.

If in one embodiment the outlet opening is provided in the recess, liquid from the product is carried to the receiving space in a simple manner via the recess and the outlet opening. If additionally the recess furthermore corresponds to the protrusion in the receiving space that forms the resistance element, as already described above, a very simple yet efficient embodiment of the container according to the present invention is obtained.

It is preferable if the partition means comprise a partition or if the partition means are configured as a partition. In such an embodiment the partition can in particular have a substantially constant thickness. Such an embodiment is very easy to produce, making it possible to form the container and/or the partition means by means of a thermoforming and/or an injection-moulding process.

In one embodiment, in order to further improve the separation between liquid and product, the part of the partition means that faces the product space defines a product support surface for the product. Furthermore, there is no absolute need for an additional wall functioning as a product support, which makes it easier to produce the container according to the present invention.

The partition means may in that case comprise protrusions that extend toward the product space, with crests of said protrusions forming at least parts of the product support surface. The protrusions only support parts of the product, so that there are parts of the products which are not in contact with the partition means, and that in such a manner that said parts of the product are in contact with the atmosphere that prevails in the product space. This aspect of the protrusions can in principle be used with any container. According to one aspect, a container for packaging products is thus provided which comprises a container body with a product space for accommodating a product and a receiving space at least for receiving liquid, preferably from the product, wherein the container body comprises partition means that separate the product space and the receiving space from each other, which partition means comprise at least one outlet opening configured for at least discharging liquid from the product space to the receiving space, wherein the part of the partition means that faces the product space defines a product support surface for the product, wherein the partition means comprise protrusions that extend toward the product space, wherein crests of said protrusions form at least part of the product support surface.

In one embodiment, the protrusions that extend toward the product space form a ribbed structure, so that the outlet opening(s) will remain open and the liquid from the product can thus be discharged to the underlying receiving space without impediment. The packaged product is thus not in contact with the liquid exuded from the product. The ribbed structure also ensures that the packaged product will not rest on a flat bottom, so that a gas that may be present in the product space can flow around the packaged product, which leads to an extended storage life of the product.

A more optimum separation of liquid from the product is realised if the outlet opening is spaced from the product support surface, seen in a direction toward the receiving space. Liquid can in that case flow from the product to the outlet opening via the aforesaid recesses, which form gutter elements, for example, under the influence of the force of gravity.

To ensure an adequate operation of the container, in particular in order to prevent the backflow of liquid from the receiving space to the product space, it is preferable if the outlet opening is provided near a central part of the container body. The outlet opening is in particular only provided near a central part of the container body, and the partition means are free from one or more outlet openings near a circumferential wall of the container body, for example. As a result, it is ensured that the backflow of liquid from the receiving space to the public space is prevented in all positions of the container, i.e. a normal position, an inclined position and even an upside-down position.

In an embodiment which provides an adequate discharge of liquid, the container comprises a multitude of outlet openings. Preferably, the openings of said multitude of outlet openings are substantially evenly spaced.

It is preferable in that regard if the openings of the multitude of openings lie in substantially the same plane. In this way an even discharge of liquid over the multitude of outlet openings becomes possible.

In a special embodiment, the openings of said multitude of outlet openings are arranged in an arcuate pattern, in particular a circular pattern.

In an alternative embodiment, which does not form part of the invention, it is conceivable that the container body and the partition means are made of at least two parts. This makes it possible to produce the partition means separate from the container body, as a result of which the partition means, for example comprising the resistance element, will be relatively easy to produce. Once produced, the at least two parts are preferably non-detachably interconnected so as to realise the liquid-separating effect of the partition means between the receiving space and the product space.

In one embodiment, the receiving space is closed by a sealing element. In one embodiment, the sealing element is provided on a side of the container body remote from the partition means. The receiving space is thus at least partially bounded by the sealing element, the partition means and a circumferential wall of the container body.

In a very efficient embodiment, the sealing element is a sealing film. Said sealing film is very easy to provide on the container, for example on the container body, for which purpose an application surface for the sealing element is provided in the container body, preferably on an underside of the container. The sealing film is preferably affixed in such a manner as to provide a non-detachable seal, thus preventing undesirable opening of the receiving space. Furthermore, it is preferable to use a relatively strong sealing film, thus preventing undesirable piercing of the sealing film and thus opening of the receiving space.

In an alternative embodiment, the container body comprises a bottom with a circumferential wall, wherein the sealing element is at least partially formed by the bottom of the container body. The partition means are in that case placed in the container body, in the innermost part of the circumferential wall thereof, and in such a manner that the receiving space is at least in part bounded by the circumferential wall, the bottom and the partition means. In an efficient embodiment, the partition means are provided in the form of an insert in the container body and preferably non-detachably connected thereto.

To realise an adequate collection of liquid in the receiving space, the at least one outlet opening and the resistance element are spaced from the sealing element.

It is noted that according to the present invention there is no longer any need for unhygienic liquid-absorbing means, such as a liquid-absorbing layer of material. The product no longer needs to be in contact with such means. The product does not come into contact with the liquid contained in the receiving space, or at least only to a reduced extent. The receiving space can thus be free from liquid-absorbing means, in particular a liquid-absorbing layer of material. In one embodiment it is conceivable, however, to nevertheless provide the receiving space with absorbing means, such as an absorbing layer of material, so as to further reduce the risk of a backflow of liquid to the product space in this manner.

In packaged condition the container comprises a product contained in the product space, in particular a food product such as a fresh meat product, wherein the product space is closed by means of a further sealing element, in particular a further sealing film. The further sealing film may be configured in a manner which is known to the skilled person, wherein said sealing film can be opened by a user from a corner point of the package, for example.

According to one aspect, the invention provides a method for packaging products, in particular food products, such as fresh meat products, comprising the steps of:

providing a container according to the invention;

placing the product in the product space of the container;

closing the product space with the product placed therein, using a further sealing element.

Using the method according to the invention, a container in packaged condition is thus obtained, as described in the foregoing.

To realise a longer storage life, the method comprises the step of providing a modified atmosphere in the container body so as to thus at least obtain a reduced oxygen concentration in comparison with the atmosphere.

The step of providing a modified atmosphere is in particular carried out so as to obtain an increased nitrogen concentration in comparison with the atmosphere.

The invention will now be explained in more detail with reference to a few exemplary embodiments in conjunction with the appended figures, in which:

FIGS. 1*a* and 2*b* are schematic cross-sectional views of an embodiment of a container according to the present invention in a normal position and in an upside-down position;

FIGS. 2*a*-2*h* are views of a container according to a first embodiment of the container of the present invention;

FIGS. 3*a*-3*h* are views of a container according to a second embodiment of the container of the present invention;

FIGS. 4*a* and 4*b* are views of a container according to a third embodiment of the container of the present invention;

FIGS. 5*a* and 5*b* are schematic views of a fifth embodiment of the container of the present invention;

FIGS. 6*a* and 6*b* are schematic views of a sixth embodiment of the container of the present invention;

Figure 9A:
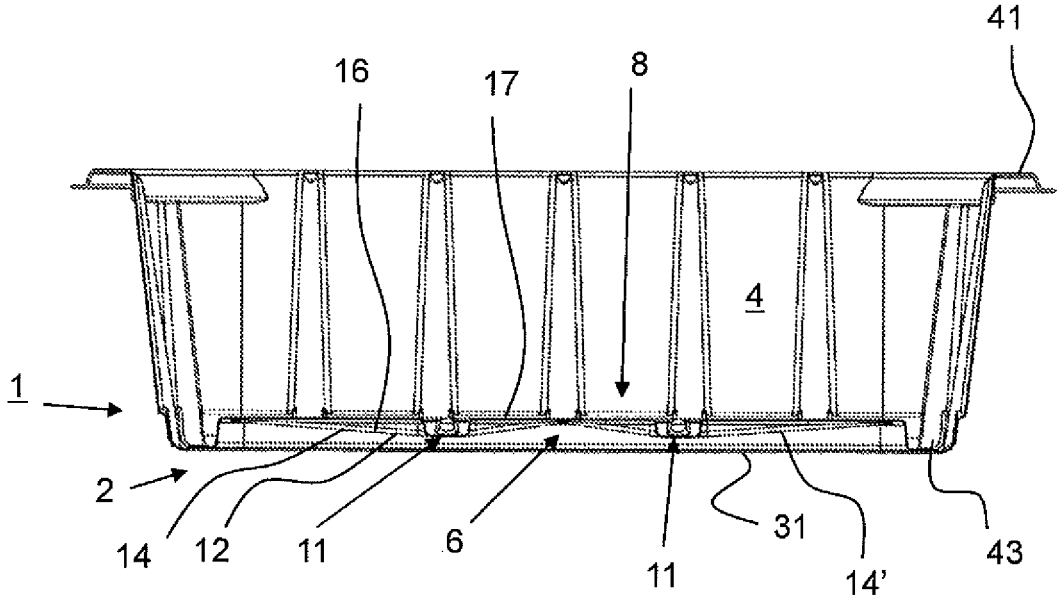
Figure 9B:
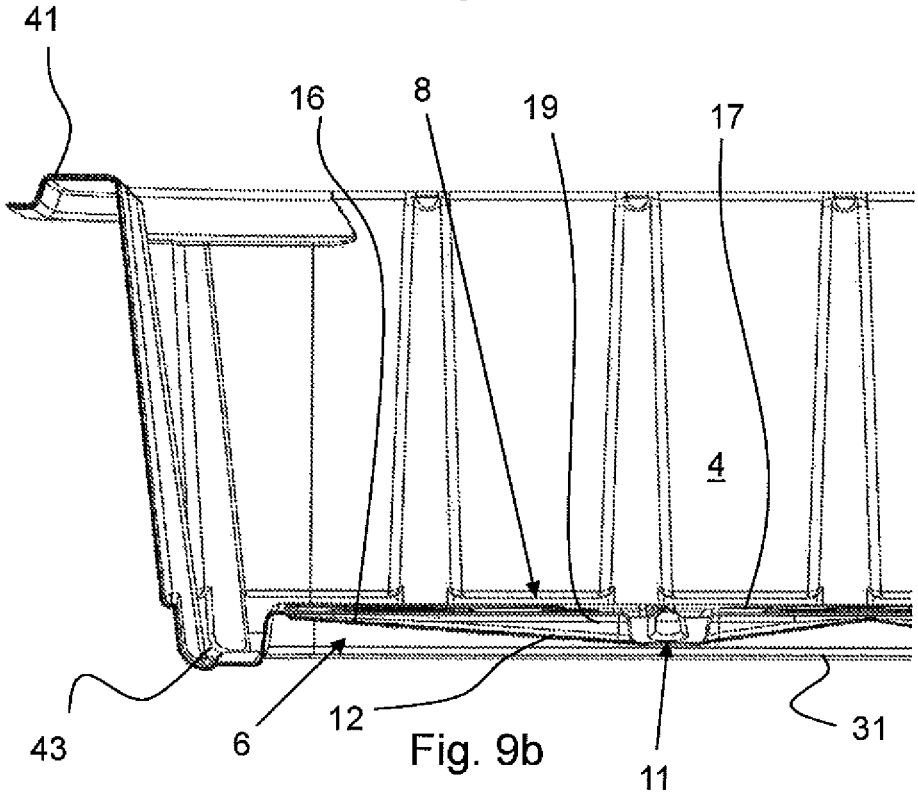
Figure 10:
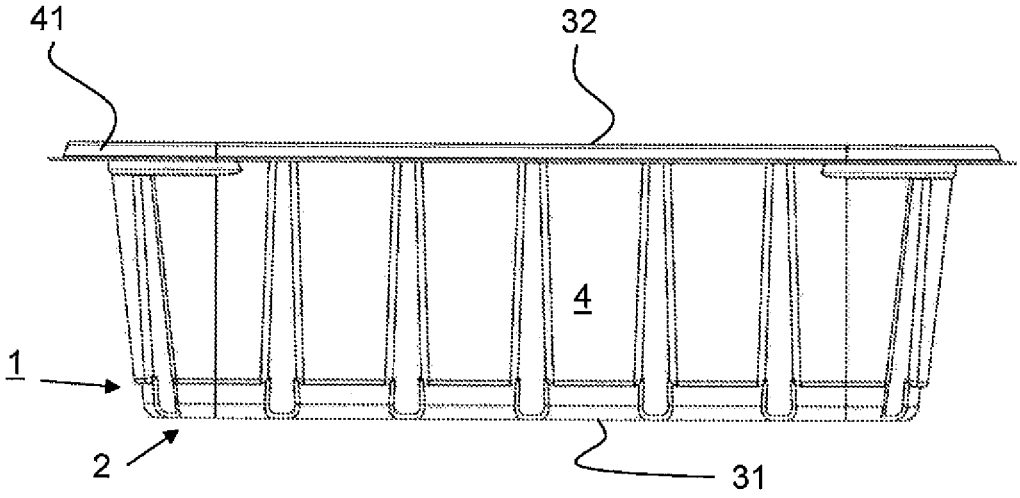
Figure 11:
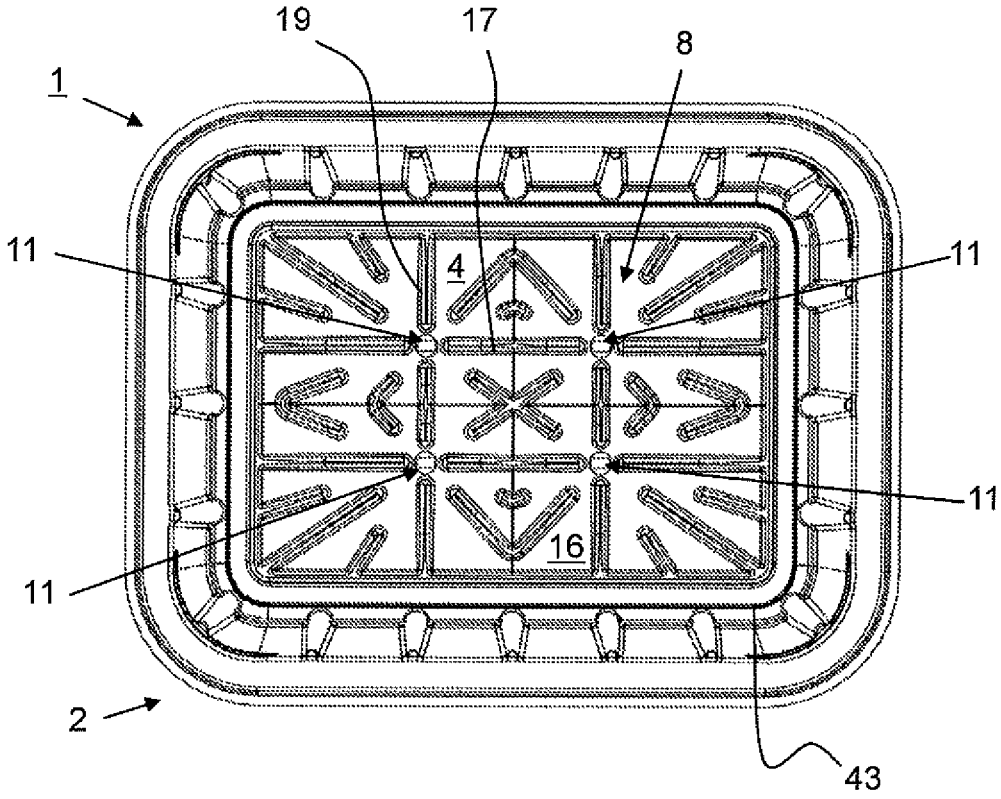
Figure 12A:
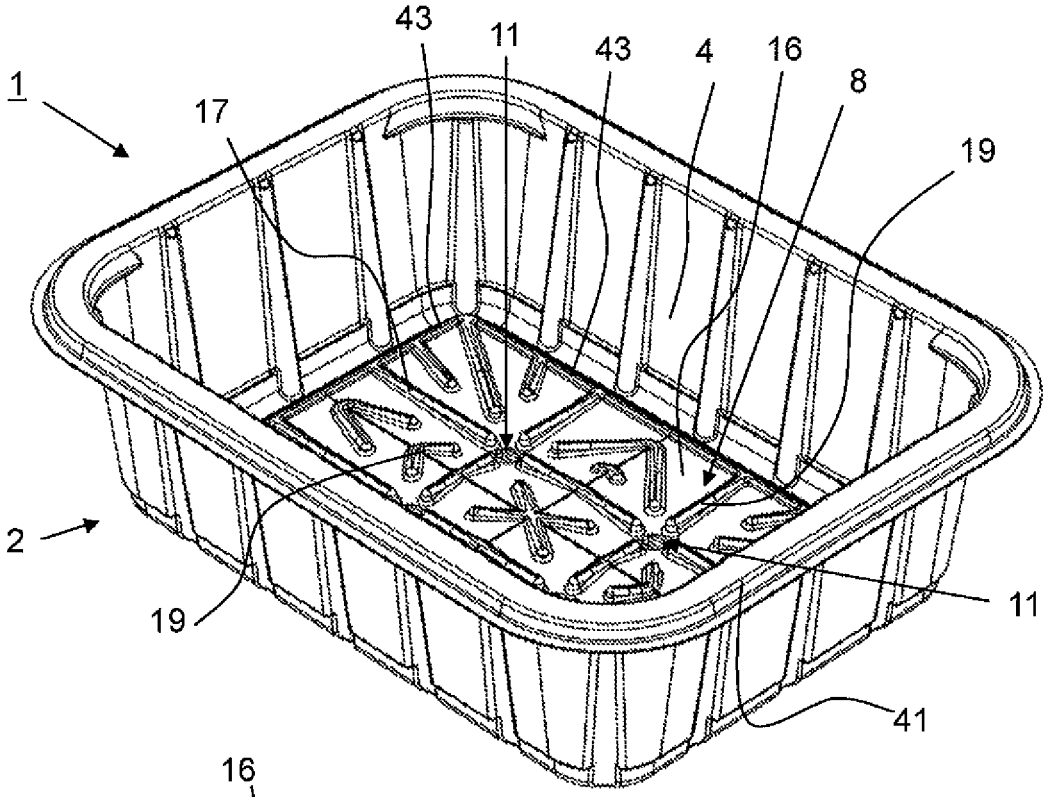
Figure 12B:
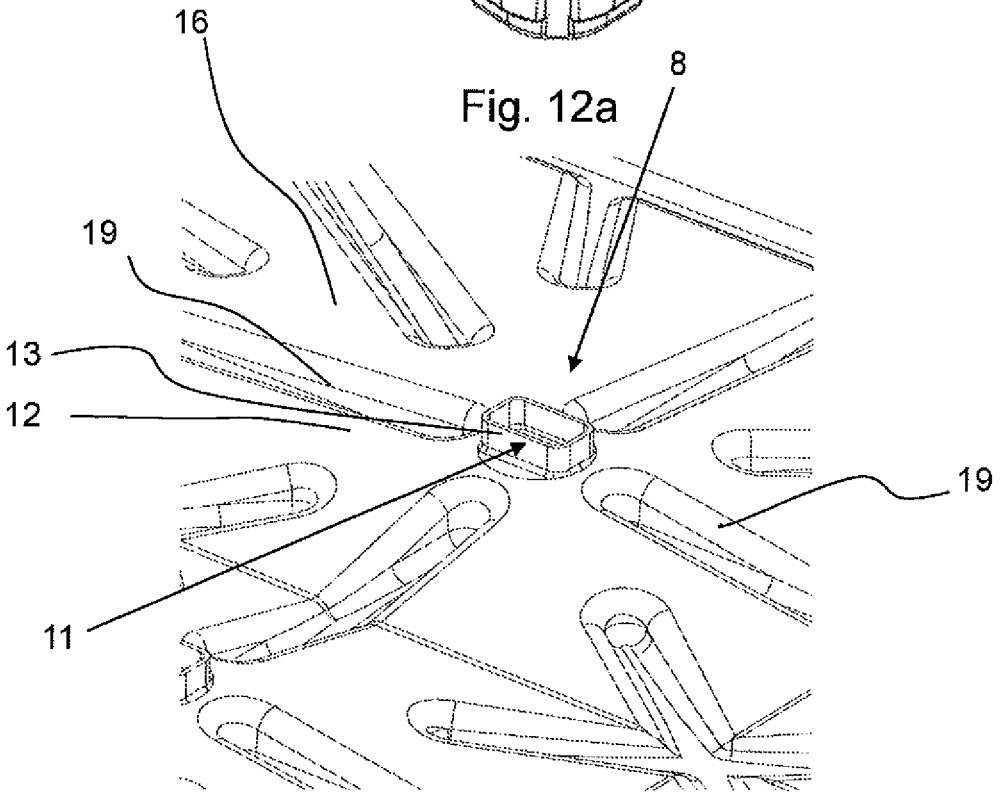
Figure 13A:
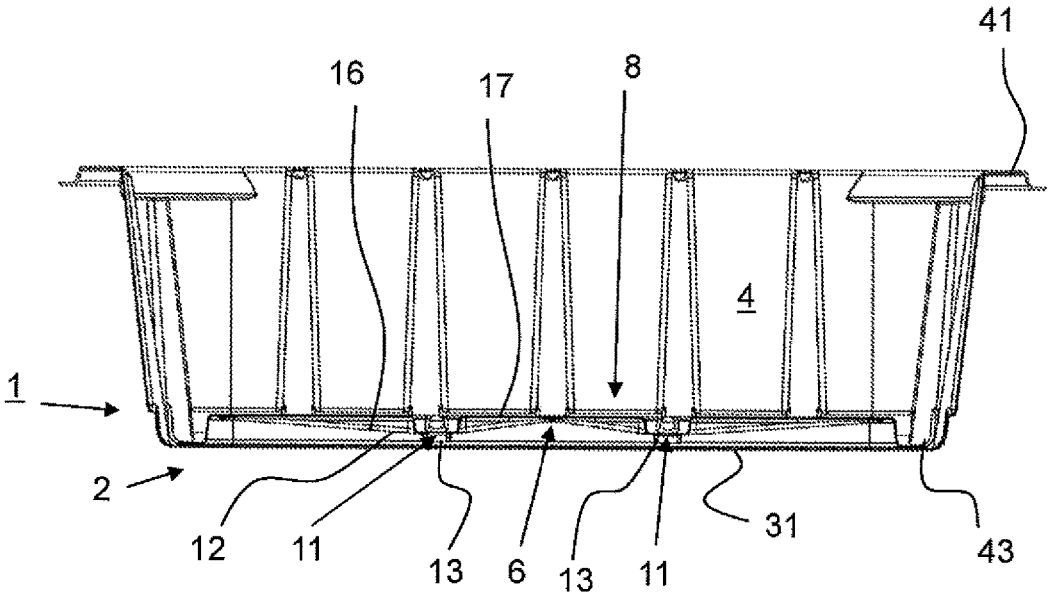
Figure 13B:
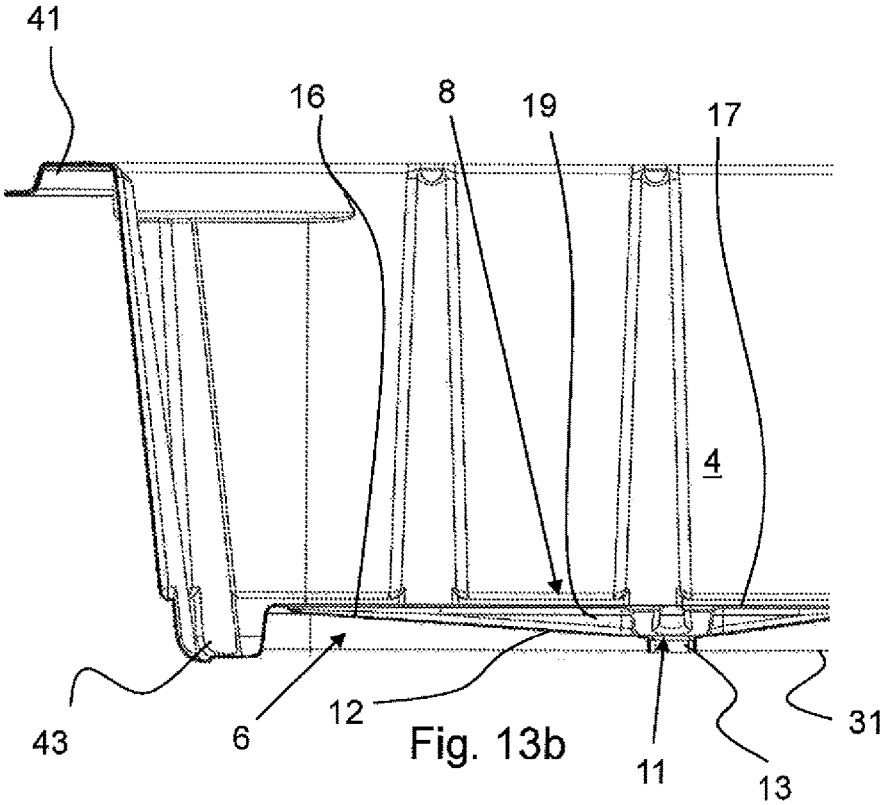

FIGS. 9*a* and 9*b* are schematic views of a section of the sixth embodiment of the container of the present invention;

FIG. 10 is a schematic side view of the sixth embodiment of the container of the present invention;

FIG. 11 is a schematic top plan view of a seventh embodiment of the container of the present invention;

FIGS. 12*a* and 12*b* are schematic perspective views of the seventh embodiment of the container of the present invention;

FIGS. 13*a* and 13*b* are schematic views of a section of the seventh embodiment of the container of the present invention.

In the description of the figures below, identical or similar parts will consistently be indicated by the same numerals. In spite of the fact that the same numerals are used, there may be differences between the various embodiments, which will become clear upon reading the description below.

Figure 1A:
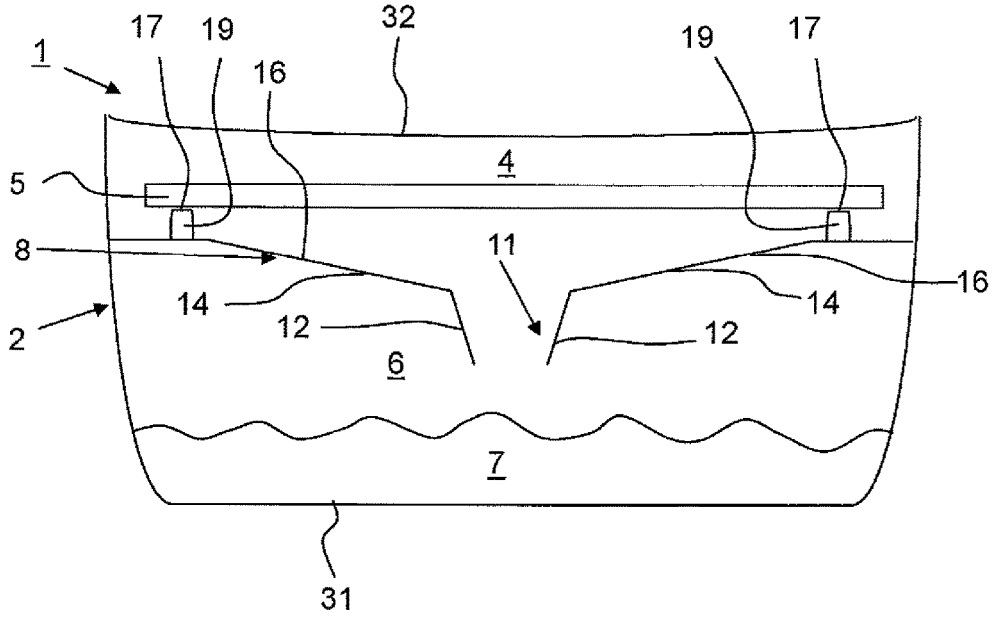
Figure 1B:
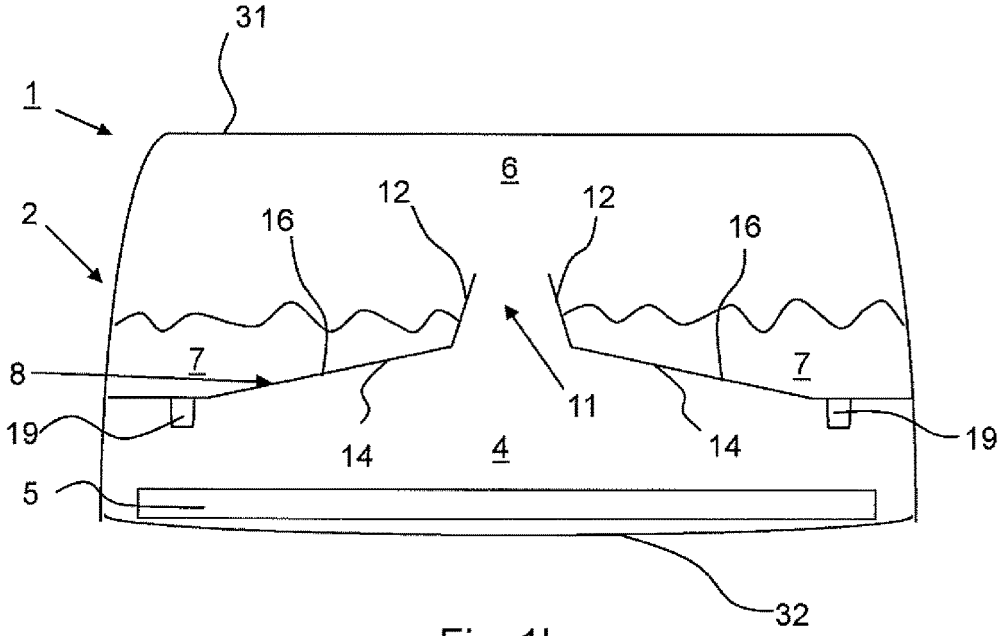

For a clear understanding of the invention, reference is first made to FIGS. 1*a* and 1*b*. These figures show a schematic sectional view of an embodiment of a container 1 according to the invention in a normal position (FIG. 1*a*) and in an upside-down (in comparison with the normal position) position (FIG. 1*b*). Reference is first made to FIG. 1*a*. The container 1 that is shown therein comprises a container body 2 made up of a few wall parts. At an upper side of the container body 2 a product space 4 is formed, in which a product 5, for example a piece of fresh meat 5, can be stored. At a bottom side of the container body 2, a receiving space 6 for liquid is formed, which space is configured to receive liquid from the product 5. The product space 4 and the receiving space 6 are separated from each other by partition means 8 in the form of a partition 16. The partition means 8, in this case the partition 16, form part of the container body 2. The partition means are designed so that the product 5 is retained in the product space 4 and will not come into contact with the receiving space 6. In this case it is ensured that the product can be hygienically stored in the product space.

The receiving space 6 is closed on the bottom side by a sealing element 31, such that the receiving space is bounded on the bottom side and on the sides by the container body 2 and the sealing element 31.

The product space 4 is closed on the upper side by a further sealing element 32, for example in the form of a sealing film. In this way a closed space 4, 6 is formed in the container 1, in this case consisting of the product space 4 and the receiving space 6. The atmosphere in the closed space 4, 6 may be modified in a manner which is known per se, for example for extending the storage life of the product.

A outlet opening 11 for liquid is present in the partition means 8. The outlet opening 11 is provided more or less centrally in the container 1 and is configured so that liquid, for example from the product 5 or in the form of condensation, can flow from the product space 4 to the receiving space 6, via the outlet opening 11, under the influence of the force of gravity. To facilitate this, the partition 16 may be provided with recesses 14, such as gutters 14, which extend downward in the direction of the outlet opening 11, so that liquid can readily flow toward the outlet opening 11. The partition means 8 may further comprise a number of protrusions 19 (schematically indicated here), which extend upward, into the product space 4, and which are configured to at least partially form a product support surface 17, on which the product 5 is at least partially supported. By suitably configuring the protrusions 19, free space can be created at the bottom side of the product, which has an advantageous effect on the storage properties of the product 5.

Furthermore, a flow resistance element 12, also referred to as resistance element 12, is provided in the receiving space 6. In the example that is shown here, the resistance element 12 forms part of the partition means 8 and is a part of the partition 16. The flow resistance element 12 extends into the receiving space 6, surrounding the outlet opening 11. This enables the resistance element to prevent or at least reduce the flow of liquid 7 from the receiving space 6 to the product space 4, in particular in the upside-down position shown in FIG. 1*b*.

As shown in FIG. 1*b*, an internal liquid container for liquid 7 is formed in the receiving space 6, as it were, which liquid container has a bottom formed by the partition means 8, in this case specifically the partition 16, and which has walls formed by a part of the walls of the container body 2 and by the resistance element 12. The internal liquid container is disposed spaced from the outlet opening 11, so that liquid present in the internal liquid container cannot directly flow to the outlet opening 11. The resistance element 12 is arranged to surround the outlet opening 11. The internal container functions to ensure that the liquid 7 is retained within the receiving space 6 in the upside-down position of the container 1 and that the liquid cannot flow back to the product space 4 via the outlet opening 11, or at least much less easily.

According to the present invention, the container 1 is thus provided with at least one resistance element 12 extending into the receiving space 6, which resistance element surrounds the outlet opening 11 in such a manner that it prevents the flow of liquid 7 from the receiving space to the product space. The resistance element 12 in particular forms walls of an internal container, which functions as such in an upside-down (in comparison with the normal situation) position. The embodiment described above with reference to FIGS. 1*a* and 1*b* is illustrative of the invention and many variants can be realised by the skilled person having read the above general description, which variants all fall within the scope of the protection sought. Thus it is in general conceivable, for example, that the internal liquid container is made up only of the partition means, in which the resistance element is incorporated. A few variants and their advantages will be discussed hereinafter.

It is furthermore noted that for the sake of clarity FIGS. 1*a* and 1*b* are not drawn to scale. The product space 4 is thus shown to be relatively small in comparison with the receiving space 6. Similarly, the outlet opening 11 is shown to be relatively large. The figures to be described hereinafter will provide a better insight into the proportions between the various parts of the container 1 according to the present invention.

In FIGS. 1*a* and 1*b*, the outlet opening is placed near a central part of the container body. In this way a maximum protection against backflow is obtained in nearly all positions of the container (i.e. also a sloping position, or in other words, a position between the normal position and an upside-down position, for example a position of the container in which the product space is positioned laterally beside the receiving space). It is not necessary to place the outlet openings centrally, however; other positions are conceivable.

FIGS. 2*a*-2*h* are views of a first embodiment of the container 1 according to the present invention.

Figure 2A:
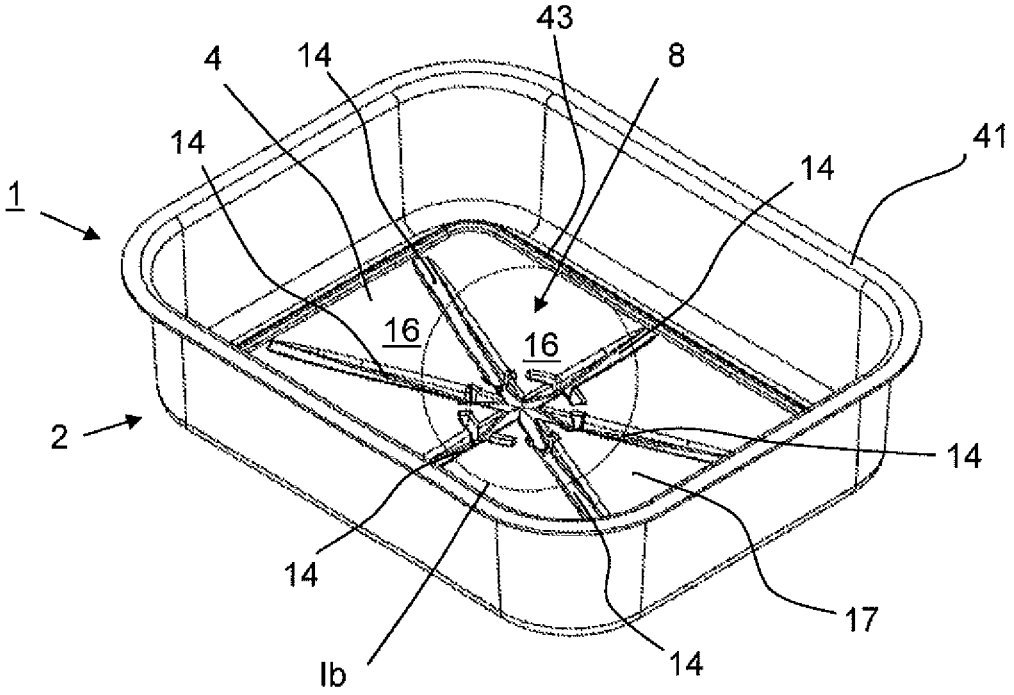

FIG. 2*a* is a perspective top plan view of the container 1. The container 1 comprises a container body 2, in this case formed by a circumferential wall 2 consisting of a few wall parts. In this way a product space 4 is formed in the container body 2. On the bottom side, the product space 4 is bounded by the partition means 8 in the form of a partition 16. The partition 16 is relatively flat on the side that faces the product space 4 and in this case forms the previously described product support surface 17 on which the product can be supported. The product can for that purpose be placed in the container 1 shown here, after which the upper side of the product space 4 is closed by means of a further sealing element (not shown), for example in the form of a sealing film, which can for example be affixed to a flanged edge 41 formed on the container body 2.

In the partition 16 a few outlet openings are provided—near the central part schematically indicated by the circle Ib—as will be explained hereinafter with reference to FIG. 2*b*. Drain gutters 14 in the form of recesses 14 in the partition 16 extend over the area of the partition 16 in the direction of the outlet openings in order to thus discharge liquid from the product space 4 in a simple and efficient manner.

On an outer side of the partition 16, a recess 43 extending in the circumferential direction is provided, which recess forms a ring channel for retaining liquid that is present near the walls of the container body 2.

Figure 2B:
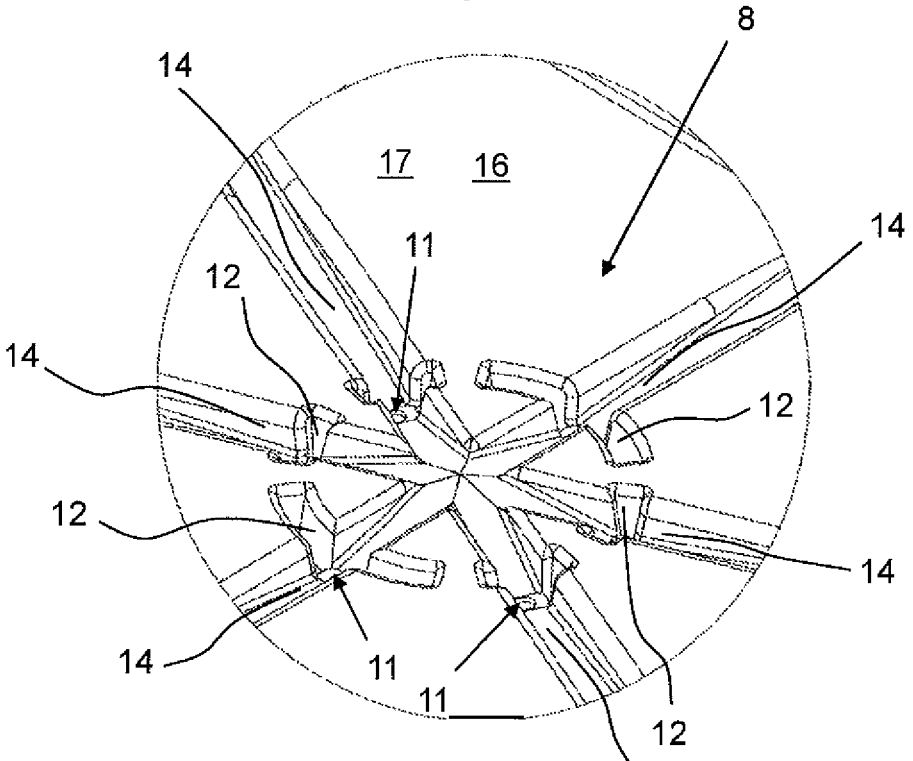

FIG. 2*b* shows the encircled part Ib of FIG. 2*a* in more detail. The drain gutters 14 are shown more clearly here, which drain gutters extend to the outlet openings 11, three of which are fully shown in FIG. 2*b*, whilst in total six outlet openings are provided. The outlet openings 11 are provided in the drain gutters 14, at a relatively lowermost part thereof. The outlet openings 11 are arranged in a circular pattern, substantially evenly spaced and substantially in one plane.

Figure 2C:
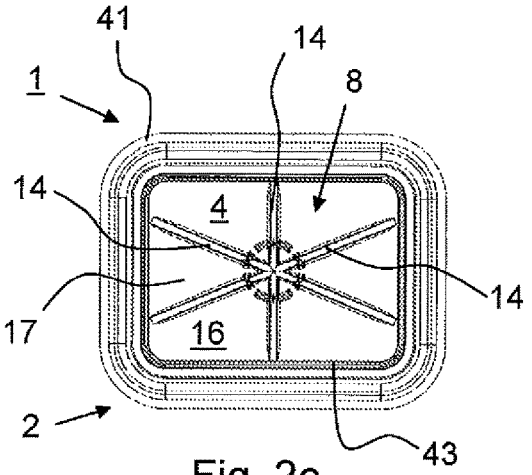
Figure 2D:
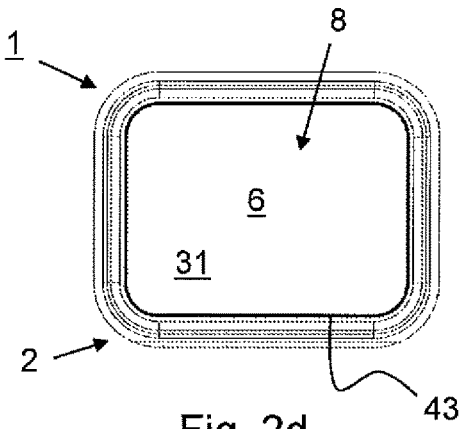
Figure 2E:
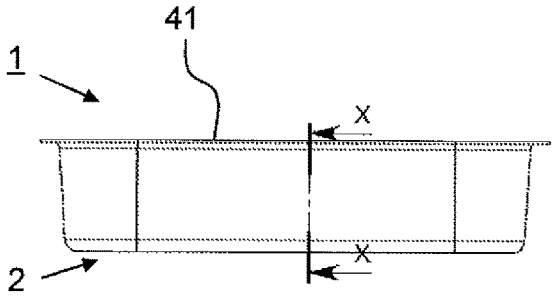
Figure 2F:
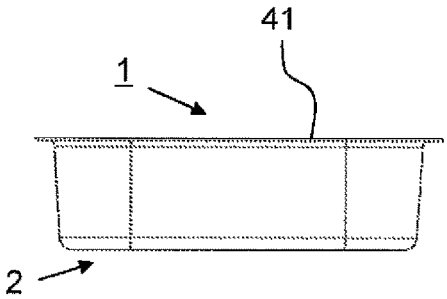
Figure 2G:
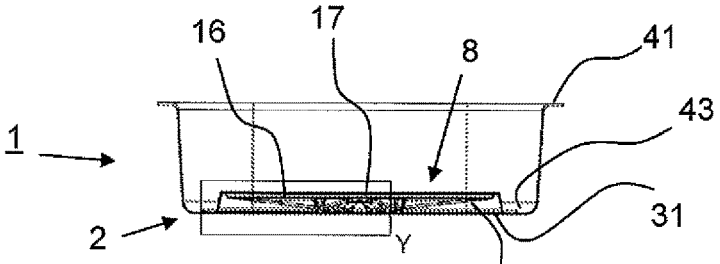
Figure 2H:
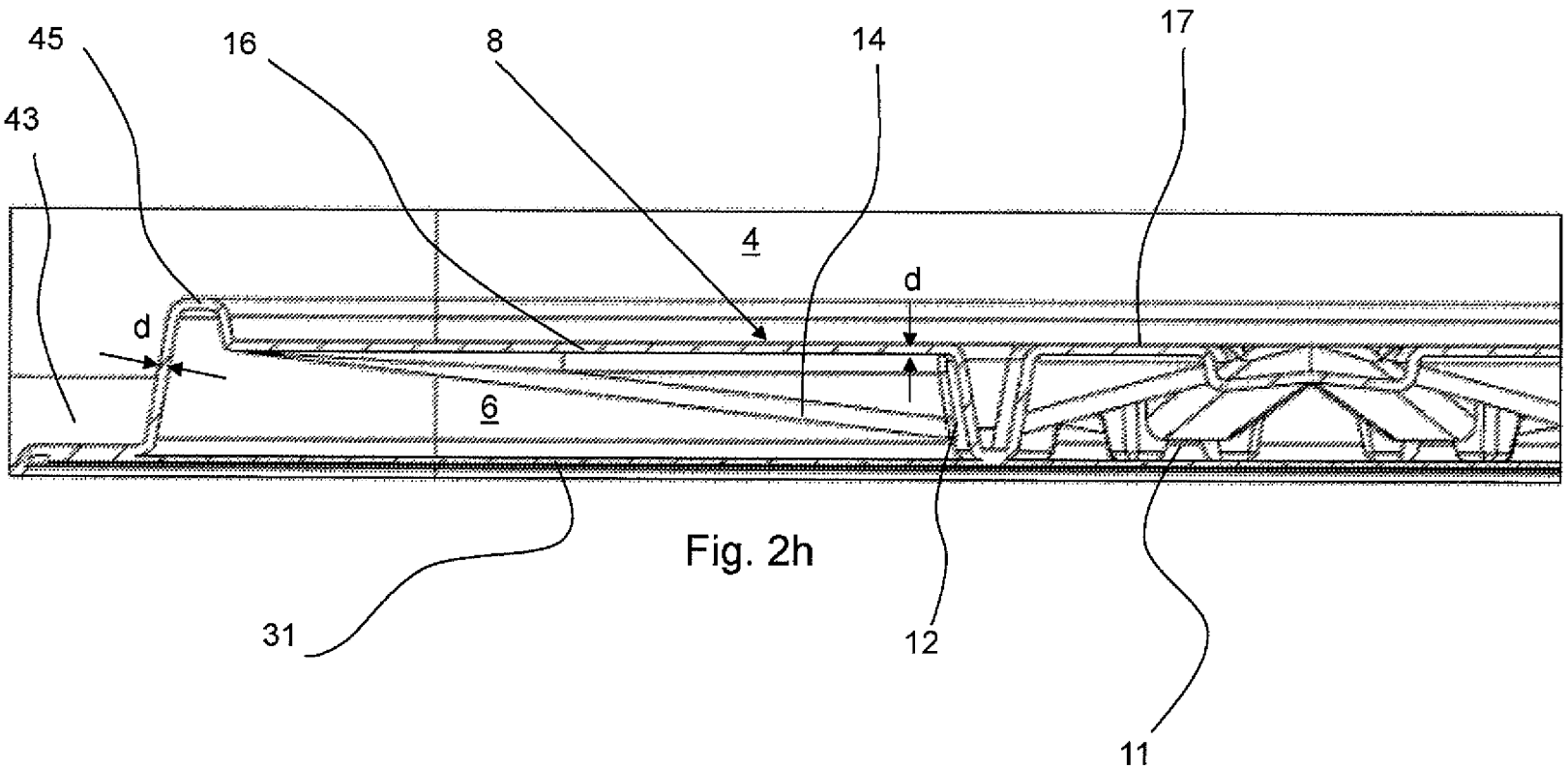

In FIG. 2*b* the outlet openings 11 are surrounded by walls 12, which, as will become clearer with reference to FIG. 2*h*, form the resistance elements 12 that prevent the flow of liquid from the receiving space 6 to the product space 4.

FIG. 2*c* is a top plan view of the container 1, showing the configuration of the product space 4 with the partition 16 that forms a product support surface 17, with drain gutters 14 and the central outlet openings 11 provided in a circular pattern.

FIG. 2*d* is a bottom view of the container 1 showing the receiving space 4, which is closed by a sealing element 31 in the embodiment shown here, which sealing element closes the receiving space on the bottom side, therefore.

FIGS. 2*e* and 2*f* are side views of the container 1 with the container body 2, which show that the container is rectangular in shape.

FIG. 2*g* is a cross-sectional view of the container 1 along the line X-X in FIG. 2*e*. This figure clearly shows that the product space 4 is relatively large and that the receiving space 6 is relatively smaller. This is possible because the amount of liquid which comes from meat products, for example, is relatively small, for example in the order of a few to a few dozen milliliters. The receiving space 6 may of course be dimensioned so that it will be capable of receiving and retaining the amount of liquid that is to be expected.

The partition means 8 in FIG. 2*g* comprise a partition 16 which slopes slightly upwards from a bottom part of the container and subsequently extends substantially parallel to the bottom formed by the sealing element 31. The receiving space 6 is thus bounded by the bottom 31 and the partition means 8 in the form of the partition 16, rather than in part by the walls of the container body 2, as is the case in FIGS. 1*a* and 1*b*. In this way a ring channel 43 is formed at the edges of the container, between the bottom, the partition 16 and the walls of the container body 2, which ring channel is positioned lower than the product support surface 17, so that liquid is collected on the outer side as well. This liquid can flow back onto the product, however, which in principle is undesirable.

FIG. 2*h* shows in detail the rectangular part of the bottom of the container 1 that is indicated by the letter Y in FIG. 2*g*. The figure shows a recess located spaced from the central part C, in this figure indicated by numeral 12, since this recess also forms the resistance element 12 in the receiving space 6. The resistance element 12 surrounds the outlet opening and extends into the receiving space 6 in the direction of the bottom 31 of the container 1. The outlet opening is not shown very clearly in this figure, since the sectional view concerns the part just before the outlet opening. An outlet opening 11 that is located a little further away is clearly visible, however; as shown, this outlet opening 11 is spaced from the sealing element 31 by some distance, such that liquid can flow from the product space 4 to the receiving space 6 in a proper manner. As already mentioned before, drain gutters 14 are for that purpose provided in the partition 16 on the side of the product space 4, a wall of which drain gutters on the side of the receiving space form a flow resistance, as is clearly shown here.

A resistance element 12 is provided for every opening 11, which resistance elements are each configured and located so that they reduce and even prevent the flow of liquid from the receiving space 6 to the product space, at least in an upside-down position of the container (in which position the receiving space 6 is located above the product space 4).

FIGS. 3*a*-3*h* show an alternative embodiment of the container 1 according to the present invention. The container is practically identical to the container described with reference to FIGS. 2*a*-2*h*; for a description of the individual FIGS. 3*a*-3*h* reference is made to the description of those figures. The main differences will be explained below.

Figure 3A:
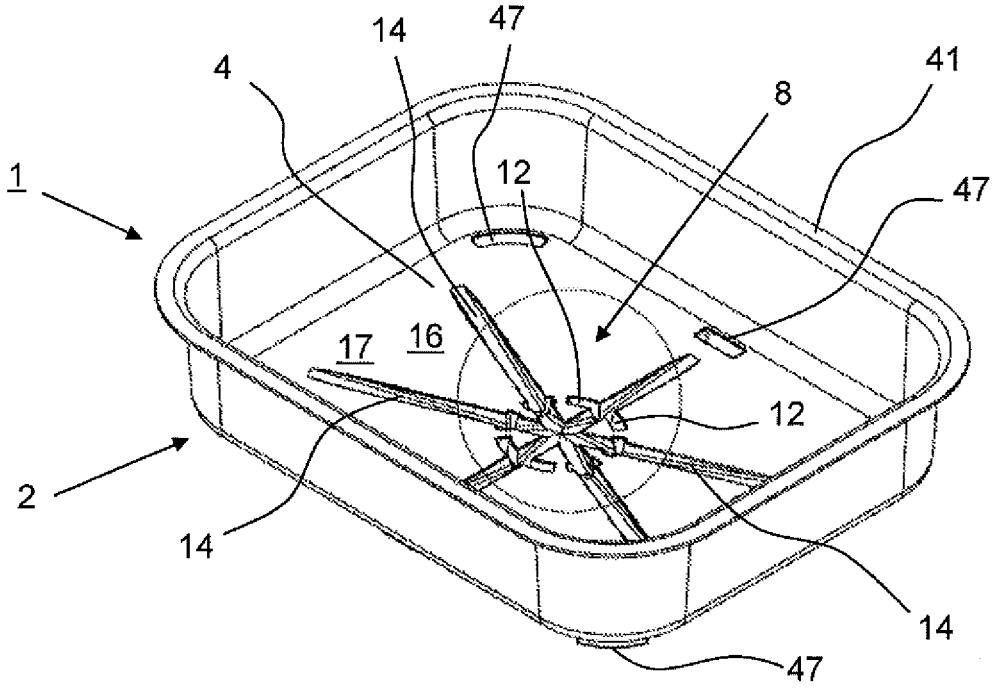
Figure 3B:
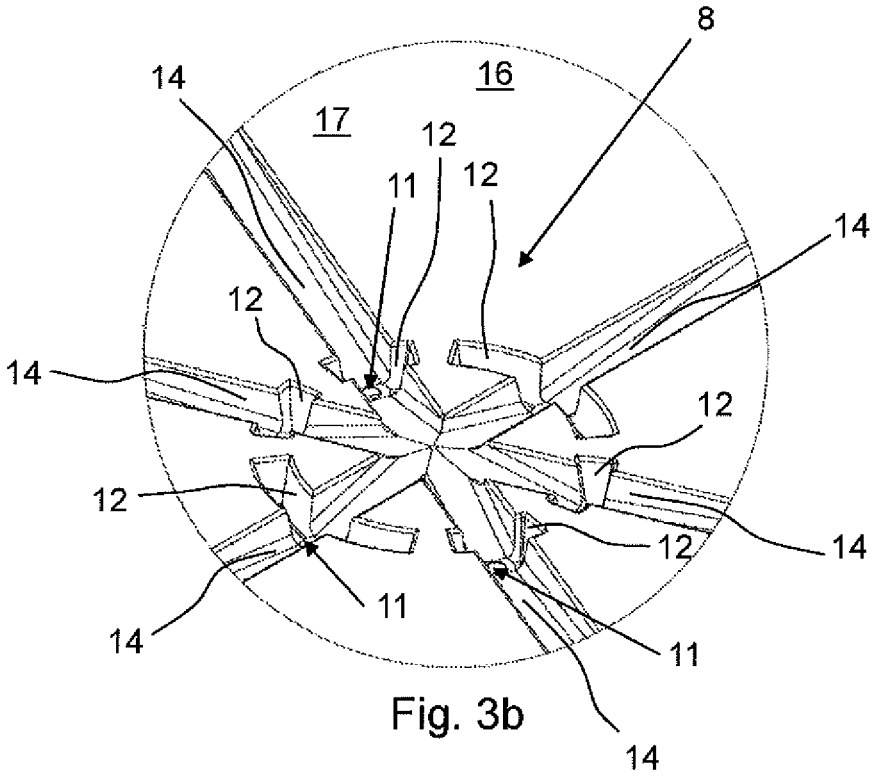
Figure 3C:
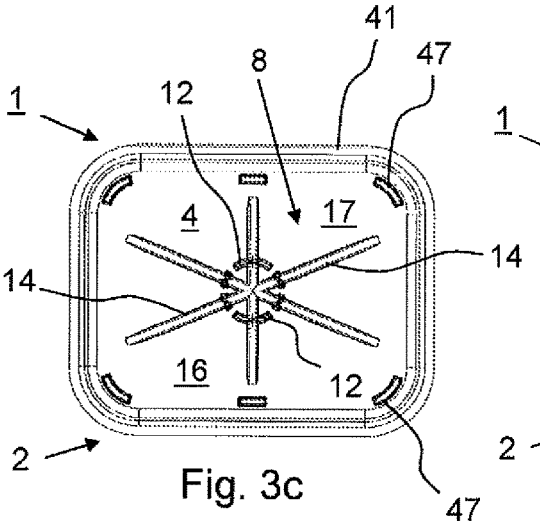
Figure 3D:
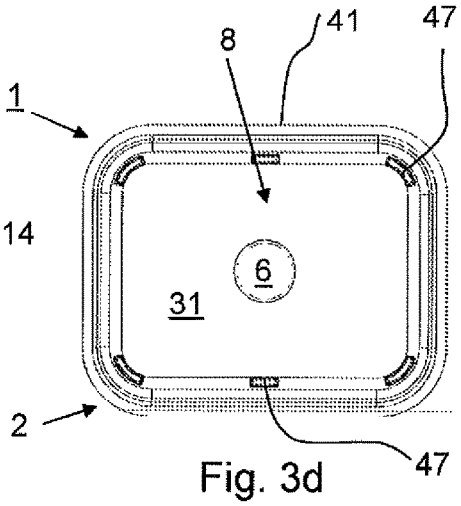
Figure 3E:
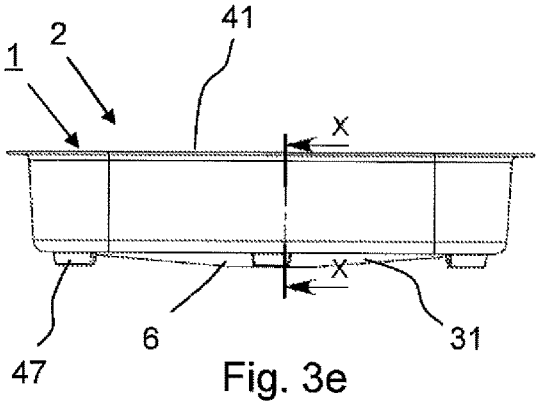
Figure 3F:
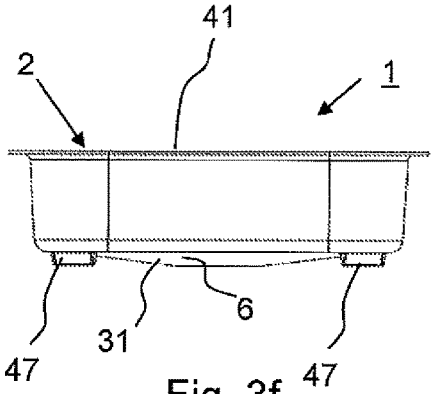
Figure 3G:
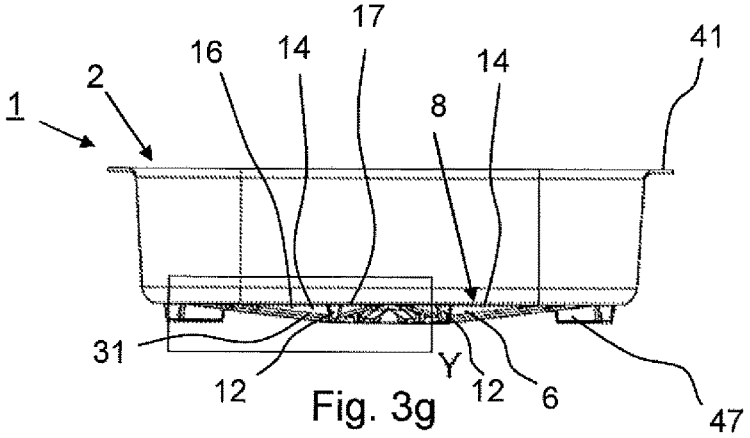

In FIG. 3*a*, the ring channel 43 of FIG. 2*a* has been exchanged for only a few recesses 47, which no longer extend along the entire circumference. Because of this, the partition means 8 in the form of the partition 16 are no longer provided as elevations on the bottom, but they are in contact with the walls of the container body 2. Such a container is relatively easy to produce, as will be explained hereinafter.

Figure 3H:
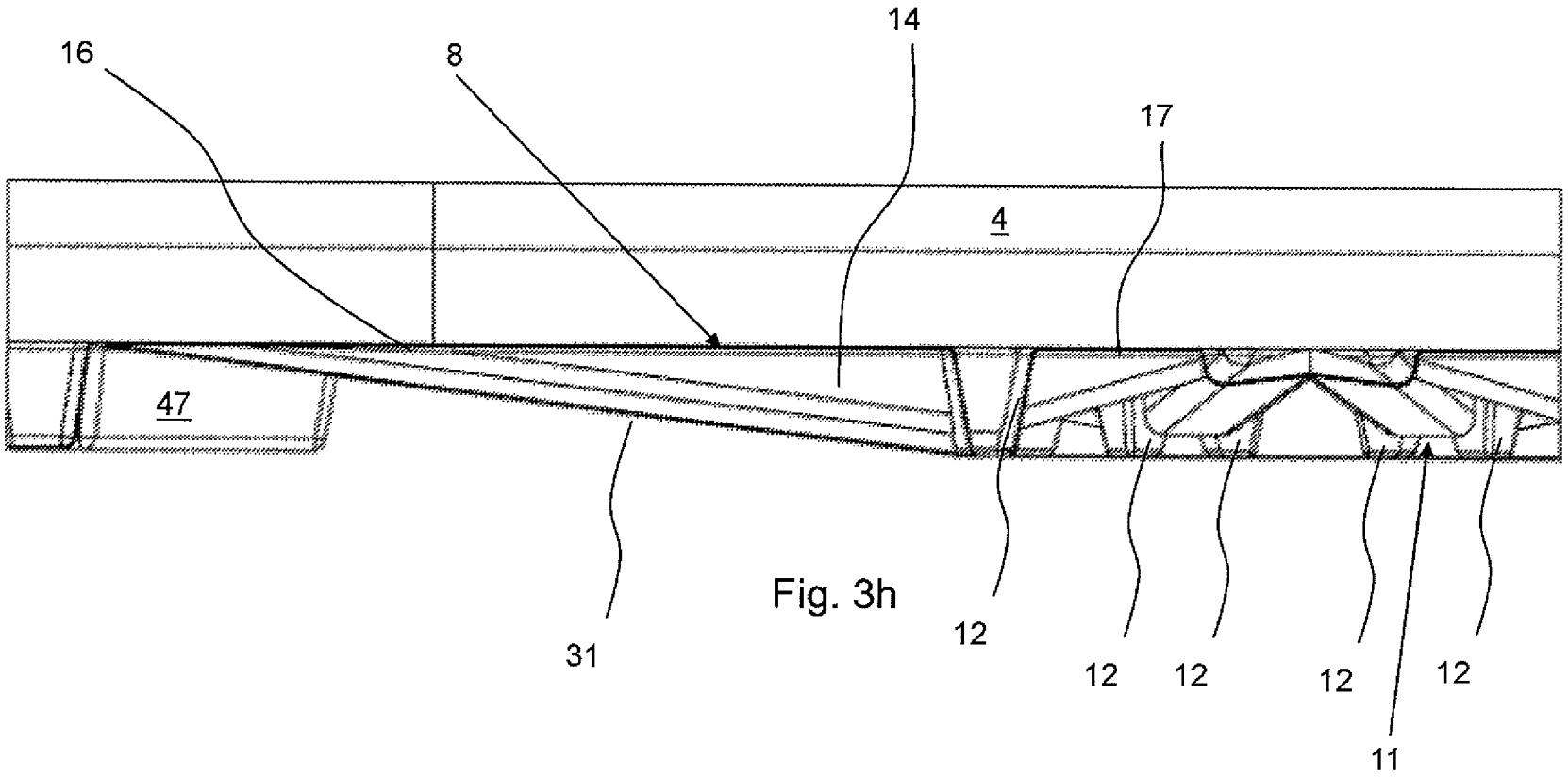

FIG. 3*h* furthermore shows the container, which is not provided with the sealing element yet. In this figure, too, the resistance elements 12 are shown again, which resistance elements form sheet pile walls of the internal container that retains liquid within the receiving space in an upside-down position of the container in that the resistance elements extend into the receiving space, surrounding the outlet openings 11. The resistance elements extend up to a point slightly lower than the outlet openings, so that there is some distance therebetween and liquid can readily flow into the receiving space. In the embodiment shown here, the receiving space is closed by means of a sealing element in the form of a sealing film, which can be affixed to the container body near the edges 47 and which extends over the bottom side of the container and may be in contact with the lower parts of the resistance elements. This makes it readily possible to form the receiving space 6, using a sealing film, whilst the outlet openings 11 cannot undesirably be closed. The container body shown in FIGS. 3*a*-3*h*, without the sealing film 31 and the further sealing film, is easy to produce, for example by thermoforming and/or injection moulding. Because of these aspects this embodiment is relatively easy to produce and that at low cost.

Figure 4A:
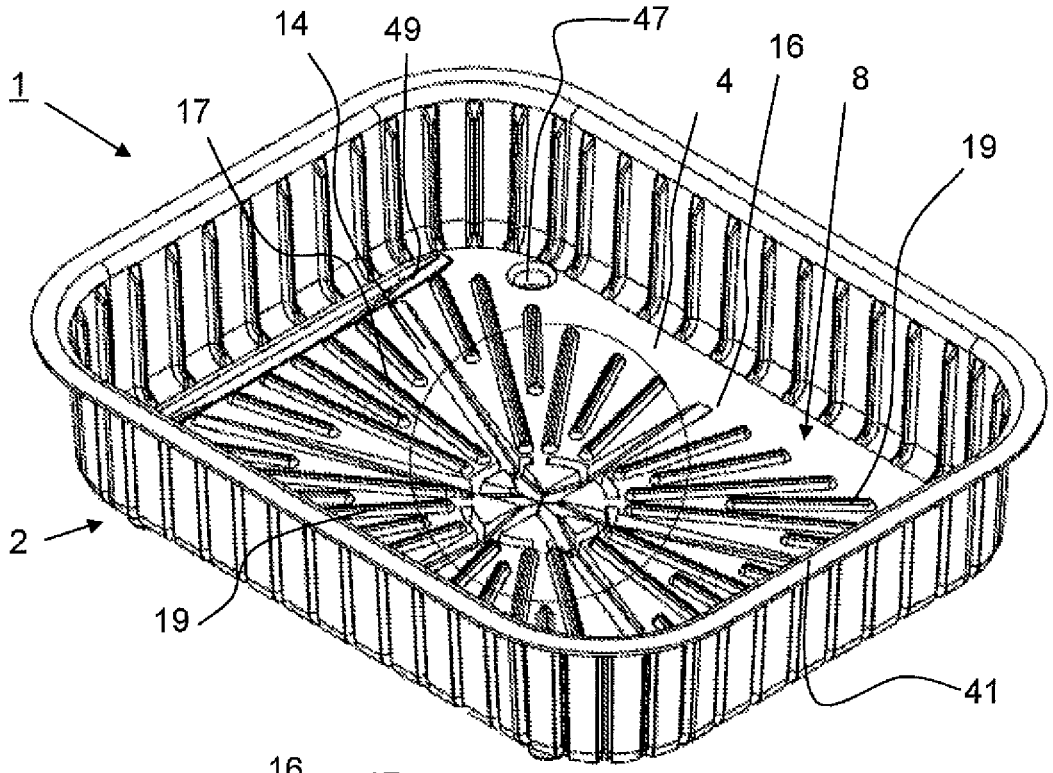
Figure 4B:
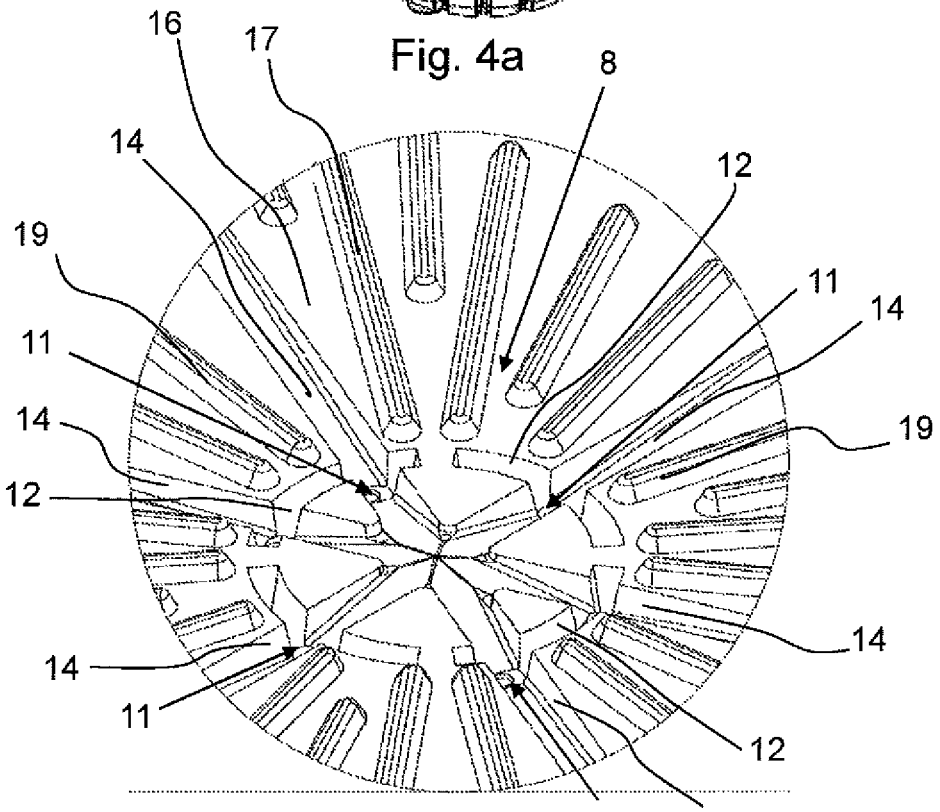

FIGS. 4*a* and 4*b* show another embodiment of the container 1 according to the present invention. The container is substantially similar to the container shown in FIGS. 2 and 3. The main differences will be explained below.

FIG. 4*a* shows that the bottom of the product space 4, which is made up of the partition means 8 in the form of the partition 16, exhibits a double curvature, i.e. the centre, indicated by a circle C here, is located lower than a part of the partition closer to the walls of the container body 2. As a result, an adequate discharge of liquid to the outlet openings 11 located near the centre C is obtained. Ribs 19 are provided on the partition, crests of which ribs form a product support surface for the product 5. The addition of ribs results in an improved contact of the product with the atmosphere prevailing inside the container 1, so that there is a good contact between the product and a preserving agent, such as nitrogen gas, for example, that is provided in the container. Drain gutters 14 are furthermore provided in the partition 16, as already described before.

FIG. 4*b* clearly shows how the ribs 19 and the drain gutters 14 extend radially from the central part of the partition means 8.

The container shown in FIGS. 4*a* and 4*b* may be provided with a sealing element, preferably in the form of a sealing film, on the bottom side for forming a receiving space on said bottom side, as already described with reference to FIG. 3.

Figure 5A:
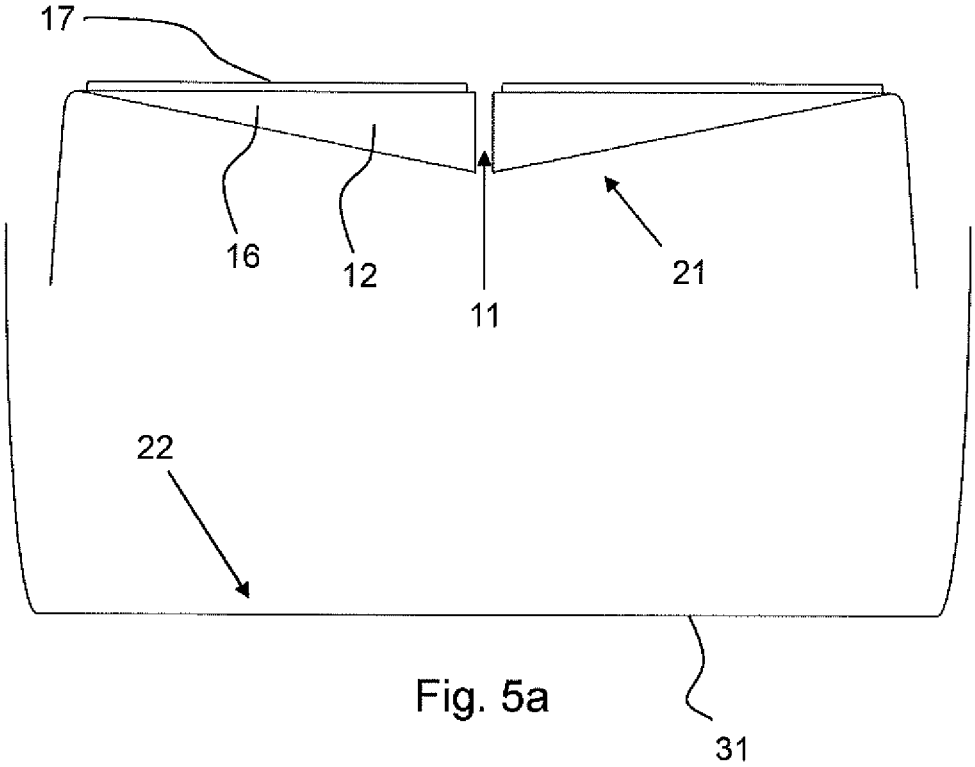
Figure 5B:
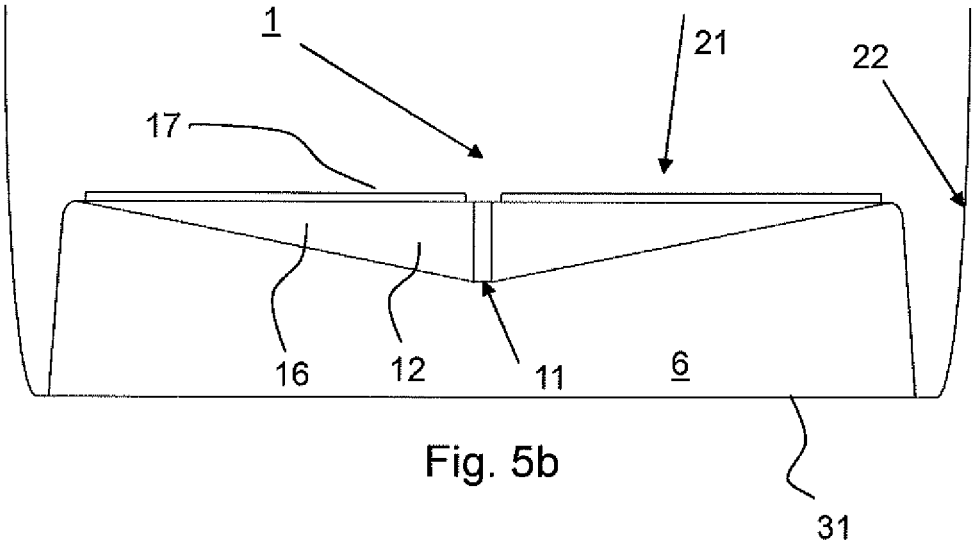

FIGS. 5*a* and 5*b* show a relatively simple embodiment of the container according to the present invention which is made of two parts, viz. a first part 21 comprising the partition means, and a second part 22 comprising the container body with the bottom 31. The first part 21 is formed as an insert 21 and comprises a wall 16 which forms a product support surface 17 on an upper side and which is provided with an outlet opening 11. On the bottom side the resistance element 12 is formed.

The second part 22 is a container body comprising a bottom 31 and a circumferential wall.

The first part 21 can be placed in the second part 22 as an insert and be connected thereto, in such a manner that a container comprising a receiving space 6 and a product space 4 separated from each other by the partition means in the form of the first part 21 is formed. After the product has been placed in the product space, the upper side of the container can be closed for storing the product in this manner, in particular for sales purposes.

According to an alternative way of producing the container according to the invention, the container body comprising the circumferential wall of the container is formed (preferably integrally) with the partition means, for example by thermoforming or injection-moulding. Subsequently, a bottom side of the container, i.e. that part of the container which is configured to form the receiving space, can be closed by means of a sealing element, in particular a sealing film. In this way a container according to the present invention can be produced in a very efficient, simple and inexpensive manner.

Figure 6A:
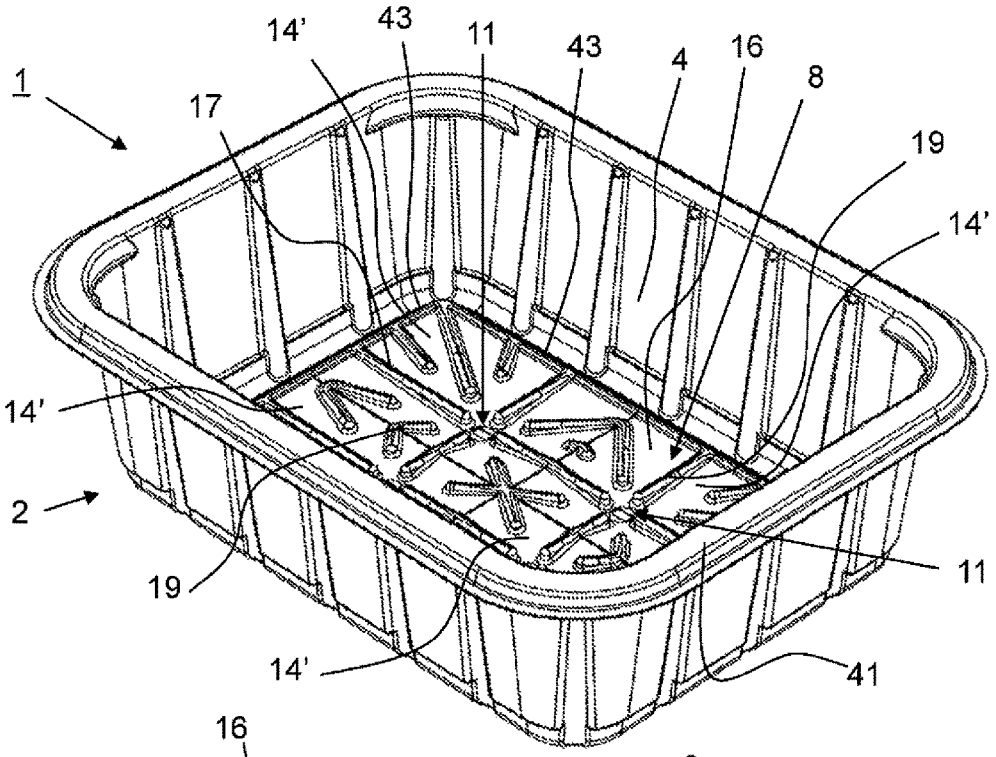
Figure 6B:
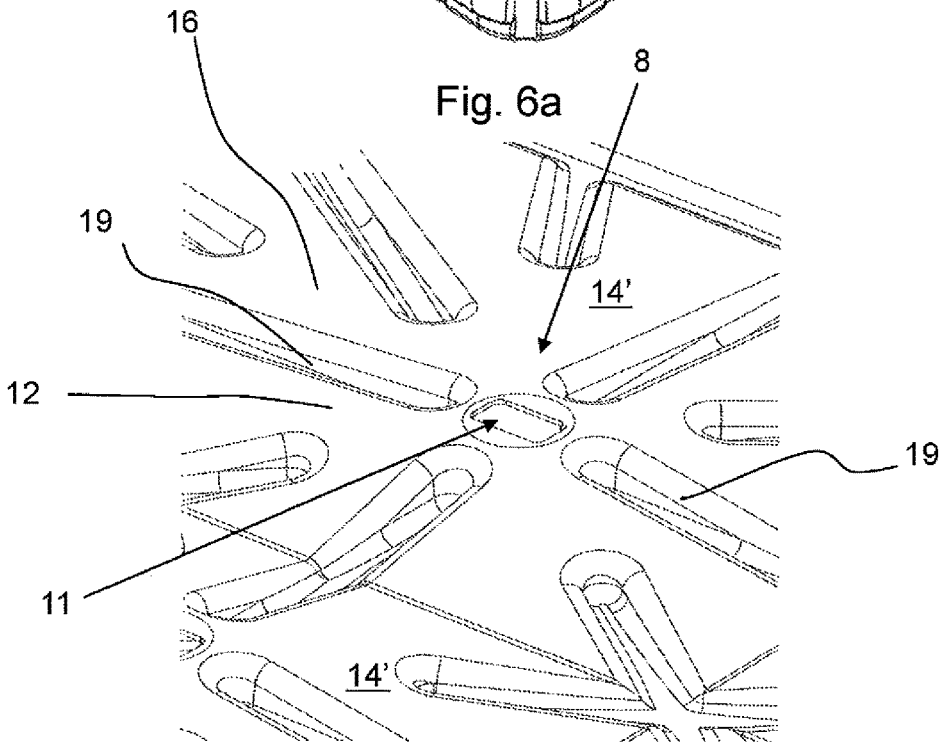

FIGS. 6*a* and 6*b* schematically show in perspective view (FIG. 6*a*) and detail view (FIG. 6*b*) a sixth embodiment of the container 1 according to the present invention. The container 1 shown in FIGS. 6-9 is essentially identical to the container 1 of FIG. 4. The main differences will be explained below.

FIG. 6*a* shows a multitude of outlet openings 11 in the partition means 8, which extend through the partition 16 toward the receiving space 6 located therebehind (not very well visible in this figure) for draining liquid thereto. The first difference between FIG. 6*a* and FIG. 4*a* is the recess 14. Whereas in FIG. 4*a* said recess 14 is provided as a downwardly extending gutter 14, in FIG. 6*a* the partition 16 is pyramidally curved such that liquid is discharged over the continuously downwardly extending partition 16 toward the outlet openings 11. The partition 16 consists of a multitude of adjoining funnel elements 14', as it were, with an outlet opening 11 in the central part of each final element 14'. In FIG. 6*a* the partition 16 is shown to be divided into a multitude of funnel elements 14' corresponding to the multitude of outlet openings 11. In order to form a substantially flat (i.e. horizontal in use) product support surface 17, the protrusions 19 are conical in shape in FIG. 6*a*. Each protrusion 19 in a funnel element 14' in FIG. 6*a* narrows in radial direction from the outlet opening 11. By using essentially the entire area of the partition 16 as a recess 14, a quick and effective discharge of liquid from the product 5 is realised.

The fact that the product 5 in the container 1 is supported by the protrusions 19 prevents the outlet openings 11 from being enclosed by the product 5. Liquid from the product 5 can thus be discharged without impediment to the underlying receiving space 6. The packaged product 5 is thus not in contact with the liquid from the product 5, which has a positive effect as regards hygiene and the storage life of the product 5.

Another advantage of the protrusions 19 of this embodiment in particular, and of all embodiments in general, is that they form a relatively small contact area with the product 5. In the prior art containers known so far, the entire underside of the products is generally in contact with the product support surface. In the container 1 according to the present invention, the product support surface 17 is formed by the protrusions 19 and thus has an interrupted aspect, so that a relatively large part of the underside of the product 5 is freely accessible to the gas mixture present in the container 1. Because this gas mixture can move around the package product 5, the preserving action thereof is enhanced. The development of bacteria is thus prevented in an effective manner. It is noted in that regard that although elongate protrusions 19 are shown in FIG. 6*a*, other relief structures can also be used in a container according to the present invention.

Finally, FIG. 6*a* is different from FIG. 4*a* in that a ring channel 43 is provided instead of a gutter 49. Said ring channel 43 is essentially identical to the ring channel of FIG. 2*a*.

FIG. 6*b* shows a larger-scale view of the side of the partition 16 that faces the receiving space 6. FIG. 6*b* thus shows the bottom side of the container 1 that is shown in FIG. 6*a*. FIG. 6*b* illustrates the tapered nature of the protrusions 19. As FIG. 6*b* shows, protrusions 19 that extend over several funnel elements 14' are tapered at both ends. Because FIG. 6*b* shows the container 1 from the bottom side, the partition 16 is curved so that in the situation shown in FIG. 6*b* the outlet opening 11 is located at the highest point of the partition 16. In the position of use, liquid from the product can readily flow to the outlet opening 11, therefore, because the outlet opening will be located at the lowest point in that situation. In an upside-down position, on the contrary, liquid is prevented from flowing back to the product space.

Figure 7:
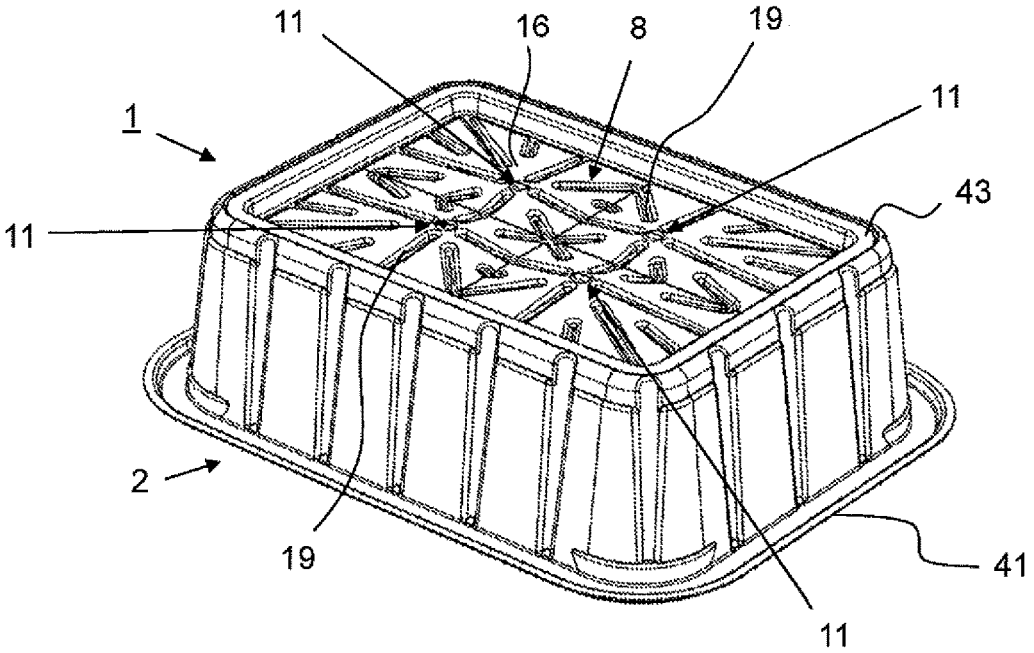
FIG. 7 is a schematic view of the sixth embodiment of the container of the present invention in an upside-down position.

FIG. 7 is a schematic view of the sixth embodiment of the container 1 according to the present invention of FIG. 6 in upside-down position. The embodiment shown in FIG. 7 essentially corresponds to the embodiment of FIG. 4, with the above-mentioned differences. The upside-down position of the container 1 in FIG. 7 shows the structure of the partition 16 as discussed with reference to FIG. 6*b*. FIG. 7 in particular illustrates the course of the ring channel 43 which, in use, also forms the contact surface of the container 1 with a bottom surface. The bottom surface of the ring channel 43 of FIG. 7 is located higher than the partition 16. On its inner side (i.e. on the side of the partition 16) the ring channel 43 has a stepped configuration, so that an additional edge for affixing the sealing element 31 thereto is formed (see also FIG. 8). As a result of this stepped construction, the sealing element 31 is spaced, in use, from the bottom surface on which the container 1 is placed.

FIG. 7 also shows that the shape of the container body 2 with the partition means 16 is such that it can be formed as an integral unit by thermoforming, for example from PP-based or APET-based materials. Other production methods and materials are also conceivable within the scope of the present invention.

Figure 8:
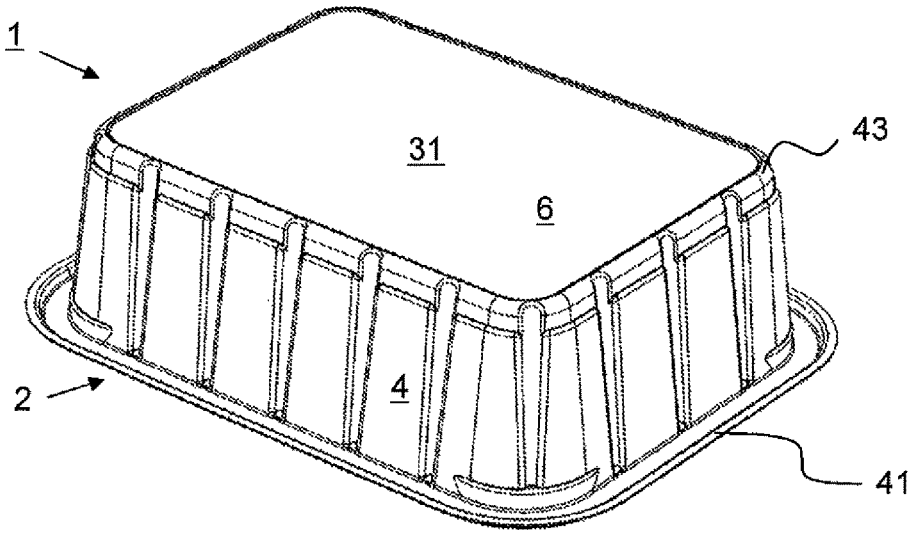
FIG. 8 is a schematic view of the sixth embodiment of FIG. 7, on which a sealing element is provided.

FIG. 8 is a schematic view of the sixth embodiment of FIG. 7, with a sealing element 31 provided thereon. The receiving space 6 in FIG. 7 is defined by the ring channel 43 and the partition 16. FIG. 8 shows that the receiving space 6 is closed by the sealing element 31. The structure of the sealing element 31 is adapted to the choice of the material of the container body 2. Preferably, the materials of the container body 2 and the sealing element 31 are selected so that there is compatibility between the outer side of the container body 2 and the sealing element 31 where the latter is affixed to the container body 2. Preferably, a molecular fusion during the sealing process ensures the permanent integrity of the seal by the sealing element 31. Furthermore, the perforation resistance of the sealing element 31 is equal to or higher than that of the further sealing element 32. The sealing element 31 preferably guarantees barrier properties equal to or higher than the thinnest part of the, preferably thermoformed, container body 2. The choice of materials thus guarantees a perfect protection of the packaged product 5 until the date of expiry thereof.

FIGS. 9*a* and 9*b* are schematic views of a section of the sixth embodiment of the container 1 of the present invention shown in FIGS. 6-8. FIGS. 9*a* and 9*b* essentially correspond to FIGS. 3*g* and 3*h*, but are different therefrom as regards the aforementioned points. FIGS. 9*a* and 9*b* show how the curvature of the partition 16 extends, so that two adjoining funnel elements 14' are formed. Each funnel element 14' is curved so that the lowest point thereof terminates in the outlet opening 11. In addition to that, FIGS. 9*a* and 9*b* show in side view the tapered nature of the protrusions 19.

FIG. 10 is a schematic side view of the sixth embodiment of the container 1 according to the present invention. In this view the further sealing element 31 in the form of an upper film 32 is affixed to the flanged edge 41. The provision of the sealing element 31 and the further sealing element 32 on the container body 2 makes it possible to confine a product 5 in a protective atmosphere within the container 1. The container 1 is preferably used in combination with a protective atmosphere (gas flushing), in particular in the case of meat or fish products (fresh meat and fish), as known to the skilled person.

FIG. 10, like the other figures, demonstrates also the strong similarity between the container 1 and the generally known meat trays. The container 1 is formed so that in the case of a container 1 according to the present invention the packaging process does not require any adaptations on the part of the producer of fresh meat/fresh fish products, whilst any adaptations as regards consumer behaviour are not necessary, either. The handling of the container 1 at a fresh meat or fresh fish packaging company can be carried out with the already existing infrastructure. In other words: the introduction of the container 1 does not require an investment from the producer. In addition to that, the similarities between the container 1 and the generally known meat trays are so strong that the consumer who comes into contact with the container 1 can continue to deal with the generally known fresh meat/fresh fish tray in the familiar way.

A special advantage is the fact that the changeover to the container 1 according to the present invention does not require any additional adaptations on the part of the producer. A detailed analysis has shown that no adaptations are required as regards the following points:

I. "nesting" the containers 1;

II. the packaging concept in which the containers 1 are delivered to the fresh meat & fresh fish industry;

III. the setup of the containers 1 on the machine and coupled thereto 1. the automatic destacking of the containers 1;
2. the manual destacking of the containers 1;

IV. the filling process of the containers 1;

V. the conveyor belt transport of the containers 1 (before filling and after filling);

VI. the gas flushing process;

VII. the application of the further sealing element 31 (printed or unprinted film);

VIII. the labelling the containers 1;

IX. the repackaging of the filled containers 1:

1. both via an automated process;
2. and via a manual process;

X. the transport of the containers 1 from the fresh meat & fresh fish packaging company to the market (hypermarket, supermarket, local shop, public market place).

A detailed consumer analysis teaches us upon introduction of the container 1 according to the present invention no adaptations in consumer behaviour are required as regards the following points:

I the presentation of the container 1 at the sales points;

II the use of the container 1 (from the shopping bag/trolley to the kitchen counter);

III the opening of the container 1;

IV the disposal of the empty container.

All the above advantages at least in part result from the inventor's insight to apply the sealing element in a recessed plane relative to the lowermost plane of the container 1 and to make use of the "inside cut seal" technology upon affixing the sealing element 31 to the (preferably thermoformed) container body 2.

FIG. 11 is a schematic top plan view of a seventh embodiment of the container 1 according to the present invention. FIGS. 12*a* and 12*b* are both schematic, perspective views of the seventh embodiment of the container 1 according to the present invention. Seen in top plan view (FIG. 11) or in perspective top plan view (FIG. 12*a*), the container body 2 in FIG. 11 is practically identical to the container 1 of FIGS. 6-10. FIG. 12*b* illustrates the difference with FIGS. 6-10, viz. that the partition 16 is provided with an additional resistance element 13 on the side remote from the product space 4, which resistance element surrounds the outlet opening 11. Said additional resistance element 13 extends from the partition 16 toward the sealing element 31, up to a position spaced from the sealing element 31. Liquid from the product 5 can thus flow via the outlet opening 11, through the additional resistance element 13, into the receiving space 6. In FIG. 12*b* the additional resistance element 13 is an elevated edge. This embodiment is very advantageous, because this additional resistance element additionally prevents the backflow of liquid into the product space 4.

FIGS. 13*a* and 13*b* are schematic views of a section of the seventh embodiment of the container 1 according to the present invention as shown in FIG. 12. FIGS. 13*a* and 13*b* illustrate how the additional resistance element 13 extends from the partition 16 up to a position spaced from the sealing element 31. The distance between the end of the additional resistance element 13 and the sealing element 31 is sufficiently large for allowing the transport of liquid from the product space 4 so as to achieve an effective discharge of liquid.

In the foregoing, the invention has been described with reference to a few exemplary embodiments. The skilled person will appreciate that many modifications and alternatives are possible within the scope of the invention. The invention is not limited to these exemplary embodiments, however. The scope of the protection sought is defined by the appended claims.

LIST OF REFERENCE NUMERALS

1 container
2 container body
4 product space
5 product
6 receiving space
7 liquid
8 partition means
11 outlet opening
12 resistance element
13 additional resistance element
14 recess
14' funnel element
16 partition
17 product support surface
19 protrusions
21,22 two parts
31 sealing element
32 further sealing element
41 flanged edge
43 ring channel
45 elevated edge
47 recesses
49 channel

The invention claimed is:

1. A container for packaging products, comprising:

a container body defining a product space for accommodating a product and a receiving space at least for receiving liquid from the product, partition means that separate the product space and the receiving space from each other, which partition means includes at least one outlet opening configured to at least discharge liquid from the product space to the receiving space; and at least one resistance element extending into the receiving space, which each resistance element surrounds a corresponding one of the at least one outlet opening in such a manner that the resistance element restricts the transport of liquid from the receiving space to the product space, wherein the container body and the partition means form an integral unit, and wherein the receiving space is closed by a sealing element, in which the sealing element is a sealing film.

2. A container according to claim 1, wherein the at least one outlet opening and the at least one resistance element are spaced from the sealing element.

3. A container according to claim 1, wherein the partition means includes a partition that is curved toward the receiving space to form the at least one resistance element.

4. A container according to claim 1, wherein the resistance element comprises a wall surrounding said at least one outlet opening that extends toward the receiving space.

5. A container according to claim 1, wherein the partition means comprises a partition that defines at least one recess that faces the product space.

6. A container according to claim 5, wherein;

the partition further defines at least one protrusion that extends toward the receiving space; and the at least one protrusion corresponds to the at least one recess.

7. A container according to claim 5, wherein the at least one outlet opening is provided in the recess.

8. A container according to claim 1, wherein the partition means comprise a partition having a substantially constant thickness.

9. A container according to claim 1, wherein a part of the partition means that faces the product space defines a product support surface for the product.

10. A container according to claim 9, wherein the partition means comprise a partition defining a number of protrusions that extend toward the product space, each of said number of protrusions including a crest forming at least parts of the product support surface.

11. A container according to claim 9, wherein the at least one outlet opening is spaced from the product support surface, seen in a direction toward the receiving space.

12. A container according to claim 1, wherein the at least one outlet opening is provided near a central part of the container body.

13. A container according to claim 1, wherein the container comprises a plurality of outlet openings, wherein the openings of said plurality of outlet openings are substantially evenly spaced.

14. A container according to claim 13, wherein the plurality of outlet openings lie in substantially the same plane.

15. A container according to claim 13, wherein the plurality of outlet openings are arranged in an arcuate or a circular pattern.

16. A container according to claim 1, wherein the receiving space is free from a liquid-absorbing layer of material.

17. A container according to claim 1, wherein a food product is contained in the product space, and wherein the product space is closed by means of a further sealing element, the further sealing element including a further sealing film.

18. A method for packaging food products, comprising the steps of:

providing a container according to claim 1;

placing the product in the product space;

closing the product space with the product placed therein, using a further sealing element.

19. A method according to claim 18, comprising the step of providing a modified atmosphere in the container body so as to obtain a reduced oxygen concentration in comparison with the atmosphere.

20. A method according to claim 19, wherein the step of providing a modified atmosphere comprises providing an increased nitrogen concentration in comparison with the atmosphere.

21. A container for packaging products, comprising:

a container body defining a product space for accommodating a product and a receiving space at least for receiving liquid from the product, partition means that separate the product space and the receiving space from each other, which partition means includes at least one outlet opening configured to at least discharge liquid from the product space to the receiving space; and at least one resistance element extending into the receiving space, which each resistance element surrounds a corresponding one of the at least one outlet opening in such a manner that the resistance element restricts the transport of liquid from the receiving space to the product space, wherein the container body and the partition means form an integral unit, wherein a part of the partition means that faces the product space defines a product support surface for the product, and wherein the partition means comprise a partition defining a number of protrusions that extend toward the product space, each of said number of protrusions including a crest forming at least parts of the product support surface.

22. A container according to claim 21, wherein the at least one outlet opening is spaced from the product support surface, seen in a direction toward the receiving space.

23. A container according to claim 21, wherein the partition has a substantially constant thickness.

* * * * *